US008778585B2

(12) United States Patent
Matsui et al.

(10) Patent No.: US 8,778,585 B2
(45) Date of Patent: Jul. 15, 2014

(54) TONER

(75) Inventors: Takashi Matsui, Suntou-gun (JP); Michihisa Magome, Mishima (JP); Tomohisa Sano, Mishima (JP); Shuichi Hiroko, Susono (JP); Yoshitaka Suzumura, Mishima (JP); Shotaro Nomura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/817,782

(22) PCT Filed: Sep. 12, 2011

(86) PCT No.: PCT/JP2011/071179

§ 371 (c)(1), (2), (4) Date: Feb. 19, 2013

(87) PCT Pub. No.: WO2012/036255

PCT Pub. Date: Mar. 22, 2012

(65) Prior Publication Data

US 2013/0143154 A1 Jun. 6, 2013

(30) Foreign Application Priority Data

Sep. 16, 2010 (JP) ..... 2010-207641

(51) Int. Cl.
*G03G 9/08* (2006.01)
*G03G 9/087* (2006.01)

(52) U.S. Cl.
CPC ..... *G03G 9/08782* (2013.01); *G03G 9/08797* (2013.01)
USPC ..... 430/108.4; 430/108.8; 430/111.4

(58) Field of Classification Search
CPC ..... G03G 9/08782; G03G 9/08797
USPC ..... 430/108.4, 108.8, 111.4
See application file for complete search history.

(56) References Cited

U.S. PATENT DOCUMENTS 5,948,582 A 9/1999 Nakamura et al.
6,051,350 A 4/2000 Inaba et al.

(Continued)

FOREIGN PATENT DOCUMENTS

JP 2002-72540 A 3/2002
JP 2002-202627 A 7/2002

(Continued)

OTHER PUBLICATIONS

PCT International Search Report and Written Opinion of the International Searching Authority, International Application No. PCT/JP2011/071179, Mailing Date Dec. 20, 2011.

*Primary Examiner* — Mark A Chapman
(74) *Attorney, Agent, or Firm* — Fitzpatrick, Cella, Harper and Scinto

(57) ABSTRACT

A toner with good low-temperature fixability even in light-pressure type fixing units, which causes no contamination of fixing films and provides images having stable image densities and excellent image quality after long-term use. The toner includes a toner particle containing a binder resin, a coloring agent, a release agents (a) and (b) The release agent (a) is a monofunctional or bifunctional ester wax; the release agent (b) is a hydrocarbon wax; a solubility of the release agent (a) into the binder resin is higher than that of the release agent (b). When tetrahydrofuran-soluble components of the toner are subjected to GPC, a proportion of components having a molecular weight of 500 or less is 2.5 area % or less. When the tetrahydrofuran-soluble components at 25° C. are subjected to SEC-MALLS, a weight-average molecular weight Mw thereof is 5,000-100,000, and the Mw and the radius of gyration Rw thereof satisfy $5.0\times10^{-4}\leq Rw/Mw\leq1.0\times10^{-2}$.

10 Claims, 4 Drawing Sheets

(56) References Cited

U.S. PATENT DOCUMENTS

| | | | |
|---|---|---|---|
| 6,077,635 | A | 6/2000 | Okado et al. |
| 6,077,636 | A | 6/2000 | Moriki et al. |
| 6,183,927 | B1 | 2/2001 | Magome et al. |
| 6,287,739 | B1 | 9/2001 | Kawakami et al. |
| 6,447,969 | B1 | 9/2002 | Ito et al. |
| 6,465,144 | B1 | 10/2002 | Hashimoto et al. |
| 6,544,708 | B2 | 4/2003 | Komoto et al. |
| 6,596,452 | B2 | 7/2003 | Magome et al. |
| 6,638,674 | B2 | 10/2003 | Komoto et al. |
| 6,653,035 | B2 | 11/2003 | Komoto et al. |
| 7,043,175 | B2 | 5/2006 | Komoto et al. |
| 7,123,862 | B2 | 10/2006 | Hasegawa et al. |
| 7,361,442 | B2 | 4/2008 | Otake et al. |
| 7,371,494 | B2 | 5/2008 | Chiba et al. |
| 7,452,649 | B2 | 11/2008 | Magome et al. |
| 7,537,877 | B2 | 5/2009 | Yoshiba et al. |
| 7,560,212 | B2 | 7/2009 | Chiba et al. |
| 7,582,401 | B2 | 9/2009 | Ogawa et al. |
| 7,638,251 | B2 | 12/2009 | Yamazaki et al. |
| 7,678,523 | B2 | 3/2010 | Hiroko et al. |
| 7,678,524 | B2 | 3/2010 | Hasegawa et al. |
| 7,811,734 | B2 | 10/2010 | Ogawa et al. |
| 7,842,446 | B2 | 11/2010 | Yanase et al. |
| 7,897,316 | B2 | 3/2011 | Yamazaki et al. |
| 7,906,266 | B2 | 3/2011 | Magome et al. |
| 7,923,190 | B2 | 4/2011 | Magome et al. |
| 7,935,467 | B2 | 5/2011 | Dojo et al. |
| 8,026,030 | B2 | 9/2011 | Moribe et al. |
| 8,227,162 | B2 | 7/2012 | Sano et al. |
| 8,426,091 | B2 | 4/2013 | Magome et al. |
| 8,426,094 | B2 | 4/2013 | Magome et al. |
| 2007/0072102 | A1 | 3/2007 | Dojo et al. |
| 2009/0047043 | A1 | 2/2009 | Dojo et al. |
| 2011/0311910 | A1 | 12/2011 | Matsui et al. |
| 2012/0045717 | A1 | 2/2012 | Hiroko et al. |
| 2012/0231384 | A1 | 9/2012 | Aoki et al. |
| 2013/0164044 | A1 | 6/2013 | Hasegawa et al. |
| 2013/0164671 | A1 | 6/2013 | Matsui et al. |

FOREIGN PATENT DOCUMENTS

| | | | |
|---|---|---|---|
| JP | 3440983 | B2 | 8/2003 |
| JP | 2004-264629 | A | 9/2004 |
| JP | 2006-343372 | A | 12/2006 |
| JP | 2008-145476 | A | 6/2008 |
| JP | 2009-151057 | A | 7/2009 |
| JP | 2010-39263 | A | 2/2010 |

TONER

TECHNICAL FIELD

The present invention relates to a toner to be used in, for example, an electrophotographic method, an electrostatic recording method, and a magnetic recording method.

BACKGROUND ART

A general electrophotographic image-forming method provides a toner image as described below by utilizing, for example, a photoconductive substance. An electrical latent image is formed on an electrostatic latent image-bearing member by various means. Next, the latent image is visualized by being turned into a toner image through development by a developing apparatus. Next, the toner image is transferred onto a transfer material such as paper as required, and is then fixed with heat, pressure, heat and pressure, or solvent vapor. An image-forming apparatus for such method is, for example, a copying machine or a printer.

A reduction in the size of the main body of a copying machine or printer employing the electrophotographic method has been requested in recent years in consideration of energy savings and space savings. In addition, meanwhile, such high durability as described below has been requested of the copying machine or printer. Namely, it is required that no reduction in image quality occurs even after images have been copied or printed on a large number of sheets.

One method for the reduction in the size of the main body of any such image-forming apparatus is the simplification of a fixing apparatus. The simplification of the fixing apparatus is, for example, film fixation that facilitates the simplification of a heat source and the construction of the apparatus. In the film fixation, the simplification of the heat source and the construction of the apparatus are facilitated. In addition, good thermal conductivity is obtained as a result of the use of a film as a fixing member. Accordingly, a first printout time can be shortened. However, the film is used while being pressed against a roller under a relatively high pressure, and hence a problem such as the wear of the film at the time of its long-term use is apt to arise.

A toner that shows good fixability even under a light pressure has been requested for suppressing such problem. In addition, meanwhile, an ability to perform development with improved stability has been requested of the toner, and an improvement in terms of such developing performance as described below has also been requested of the toner. A high image density and high image quality can be obtained even at the time of its long-term use.

Investigations from various aspects such as a toner structure and the improvement of a release agent have been conducted on such problems as described above concerning, for example, the fixability of the toner and development stability at the time of its long-term use.

Proposed in Patent Literature 1 are a polymerized toner of such a core-shell type structure that core particles formed of colored polymer particles each containing a polyfunctional ester compound, a Fischer-Tropsch wax, and a coloring agent are each covered with a shell formed of a polymer having a glass transition temperature higher than the glass transition temperature of a polymer component that forms each of the core particles, in which the usage ratio between the polyfunctional ester compound and the Fischer-Tropsch wax is 5/5 to 29/1, and a method of producing the toner.

In addition, Patent Literature 2 proposes a method of producing a toner including polymerizing a polymerizable monomer composition having at least a polymerizable monomer and a coloring agent in an aqueous medium, the method of producing a toner being characterized in that a peroxide-based initiator of a dicarbonate type is used as a polymerization initiator.

In addition, Patent Literature 3 proposes a magnetic toner having toner particles each containing at least a binder resin, a wax, and a magnetic powder, and an inorganic fine powder, the magnetic toner being characterized in that the toner particles have an average circularity of 0.960 or more, that substantially no magnetic powder is exposed to the surface of each toner particle, and that the wax has at least two endothermic peaks in differential calorimetry, one of the endothermic peaks is present in the range of 40 to 90° C., and the other is present in the range of 70 to 150° C.

Although fixability is improved in an ordinary fixing unit construction by each of those toners, each of those toners has showed insufficient fixability in the film fixation of a light-pressure type like the present invention. In addition, the following new problem has become recognized. The releasability of each of the toners from the fixing member reduces probably owing to the fact that the fixing unit construction of the present invention is of a light-pressure type, and hence the contamination of the fixing film occurs. Further, the toners each still have had room for improvements in image density and image quality at the time of its long-term use as well.

CITATION LIST

Patent Literature

PTL 1: Japanese Patent No. 03440983
PTL 2: Japanese Patent Application Laid-Open No. 2006-343372
PTL 3: Japanese Patent Application Laid-Open No. 2002-072540

SUMMARY OF INVENTION

Technical Problem

An object of the present invention is to provide a toner that has solved such problems as described above. That is, the object of the present invention is to provide a toner that shows good low-temperature fixability even in a light-pressure type fixing unit construction and can reduce the contamination of a fixing film. Another object of the present invention is to provide a toner with which an image having a stable image density and excellent image quality can be developed even after its long-term use.

Solution to Problem

The present invention relates to a toner, including a toner particle containing a binder resin, a coloring agent, a release agent (a), and a release agent (b), in which:

(1) the release agent (a) is a monofunctional or bifunctional ester wax;

(2) the release agent (b) is a hydrocarbon wax;

(3) a solubility of the release agent (a) into the binder resin is higher than a solubility of the release agent (b) into the binder resin;

(4) when tetrahydrofuran-soluble components of the toner are subjected to measurement by gel permeation chromatography (GPC), a proportion of components having a molecular weight of 500 or less is 2.5 area % or less; and (5) when tetrahydrofuran-soluble components of the toner at 25° C. are subjected to measurement by size exclusion chromatography-multiangle laser light scattering (SEC-MALLS), a weight-average molecular weight Mw thereof is 5,000 or more and 100,000 or less, and the weight-average molecular weight Mw and a radius of gyration Rw thereof satisfy the following equation 1.

$$5.0\times10^{-4}\leq Rw/Mw\leq1.0\times10^{-2} \quad \text{Eq. 1}$$

Advantageous Effects of Invention

According to the present invention, it is possible to provide the toner that shows good low-temperature fixability even in a light-pressure type fixing unit construction and can reduce the contamination of a fixing film. It is also possible to provide the toner with which an image having a stable image density and excellent image quality can be developed even after its long-term use.

DESCRIPTION OF EMBODIMENTS

Figure 1:
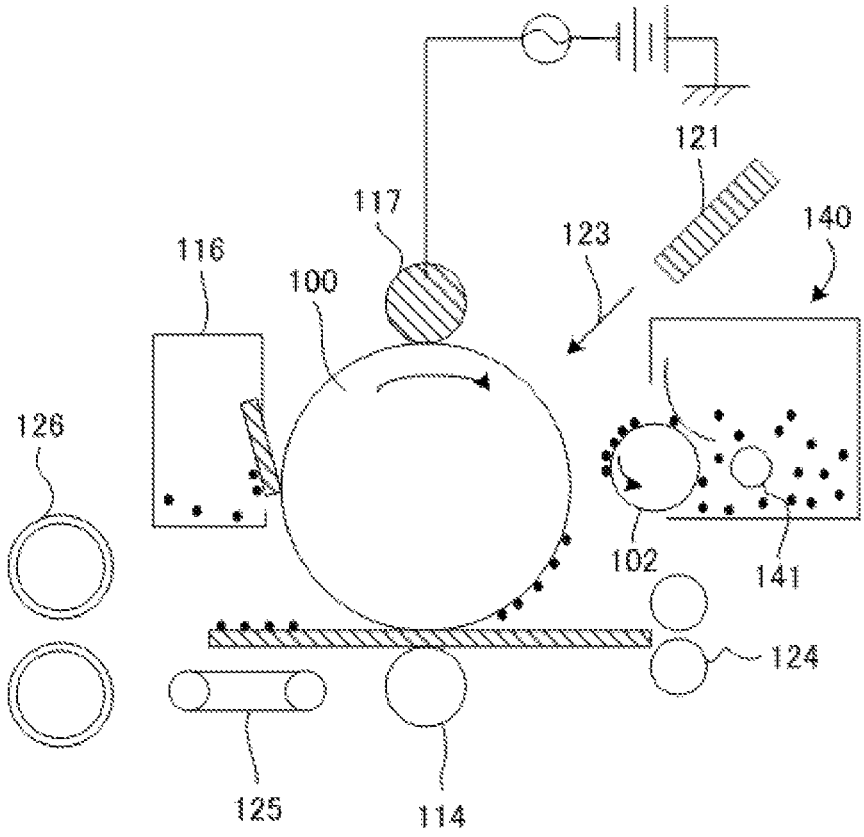
FIG. 1 is a schematic sectional view illustrating an example of an image-forming apparatus in which a toner of the present invention can be suitably used.

The present invention relates to a toner, and a conventionally known electrophotographic process can be applied to each of an image-forming method and a fixing method without any particular limitation.

Investigations conducted by the inventors of the present invention have found that none of a mere reduction in the molecular weight of a binder resin, a mere reduction in the glass transition temperature of the binder resin, and mere incorporation of a large amount of a release agent suffices for an improvement in fixability in a light-pressure type fixing unit construction. First, when the improvement of the binder resin such as the reduction in the molecular weight of the binder resin or the reduction in its glass transition temperature is performed, such a tendency that the viscoelasticity of the binder reduces and the low-temperature fixability of a toner is improved is observed indeed. However, a fixing pressure is low in the light-pressure type fixing unit construction, and hence the toner cannot sufficiently deform and dot reproducibility reduces. In addition, heat hardly propagates through the toner in a uniform fashion owing to the low fixing pressure, and hence the uniformity of the density of an image formed with the toner reduces. Further, a fixation failure (so-called fixation offset) occurs, and hence a fixing film is contaminated in some cases.

Next, when the release agent is incorporated in a large amount, the plasticity and releasability of the toner tend to be improved. However, the fixing pressure is low in the light-pressure type fixing unit construction even when the release agent is incorporated in a large amount. Accordingly, the toner cannot sufficiently deform and the dot reproducibility reduces. In addition, a balance cannot be established between the plasticity and the releasability. As a result, the fixation failure is apt to occur, and hence the fixing film is contaminated in some cases.

Further, even a toner obtained by combining the above-mentioned cases, i.e., the improvement of the binder resin and the incorporation of a large amount of the wax is still in an insufficient state because the dot reproducibility reduces, or an image suffering from a fixation failure or low density uniformity is obtained.

In addition, a toner with its fixability improved by any such existing technique as described above is poor in image stability at the time of its long-term use, and its influences on an image such as a reduction in density and a reduction in image quality are observed. In addition, owing to the mere reduction in the molecular weight of the binder resin, the mere reduction in the glass transition temperature of the binder resin, or the mere incorporation of a large amount of the release agent (a) reduction in the developability of the toner occurs in some cases after the toner has been left to stand under a high-temperature, high-humidity environment. The foregoing suggests that the toner still has room for improvement to simultaneously achieve both fixability and developability.

Further, the inventors of the present invention have continued extensive studies, and as a result, have found that a toner extremely excellent in plasticity and releasability can be obtained by controlling the molecular weight and branched structure of a binder resin, and selecting such a release agent (a) and a release agent (b) as described below. The release agent (a) easily exists in a state of being compatibilized with the binder resin in the toner and has excellent plasticity, and the release agent (b) easily exists in such a state as to form a domain in the toner and has excellent releasability. Further, it has also been elucidated that the sharp melt property of the toner can be significantly improved by the control and selection. Thus, the toner can show good fixability even in a light-pressure type fixing unit construction.

The inventors of the present invention have considered that the fact that such results were obtained is attributable to the following reasons.

The plasticization of the toner and an improvement in its releasability are important conditions necessary for improving fixability in a light-pressure type fixing unit construction.

In the present invention, a monofunctional or bifunctional ester wax and a hydrocarbon wax are used in combination as release agents. When the release agents are used together with a styrene-acrylic resin, polyester resin, or the like to be generally used as a binder resin, the monofunctional or bifunctional ester wax mainly plasticizes the binder resin to improve the low-temperature fixability of the toner, and the hydrocarbon wax mainly improves the releasability of the toner.

It has been found that the present invention provides, by combining those release agents with a specific binder resin as a feature of the present invention, an effect that cannot be expressed when each of the release agents is used alone or when the respective release agents are combined with a conventional binder resin while the release agents are used in combination.

The binder resin to be used in the toner of the present invention satisfies the following conditions (i) and (ii):

(i) when the tetrahydrofuran-soluble components of the toner are subjected to measurement by gel permeation chromatography (GPC), a proportion of components having a molecular weight of 500 or less is 2.5 area % or less; and (ii) when the tetrahydrofuran-soluble components of the toner are subjected to measurement by size exclusion chromatography-multiangle laser light scattering (SEC-MALLS), their weight-average molecular weight Mw is 5,000 or more and 100,000 or less, and the weight-average molecular weight Mw and their radius of gyration Rw satisfy the relationship of $5.0\times10^{-4}\leq Rw/Mw\leq1.0\times10^{-2}$.

It is insufficient that the binder resin to be used in the toner of the present invention merely has a low molecular weight, and it is important to control the branched state of the molecular chain of the binder resin as well. That is, an object of the present invention is achieved by the fact that the tetrahydrofuran-soluble components of the toner of the present invention each do not have a branched type molecular structure but have a molecular structure close to a linear type. The adoption of a molecular structure close to a linear type molecular structure improves the thermoplasticity of the toner, thereby enabling the toner to sharply melt. It should be noted that in the present invention, the branched state of the binder resin in the toner is specified on the basis of the branched state of each tetrahydrofuran-soluble component of the toner, provided that the toner may contain a tetrahydrofuran-insoluble component as long as its content is 40 mass % or less of the binder resin.

Further, the dispersibility of the monofunctional or bifunctional ester wax that easily imparts plasticity in the binder resin is markedly improved by controlling the molecular weight and branched state of the binder resin like the present invention. This is because of the following reason. When the monofunctional or bifunctional ester wax is introduced into the binder resin having a linear type molecular structure and in a state of being reduced in molecular weight, the monofunctional or bifunctional ester wax itself is also of a linear type molecular structure and hence made to easily enter the binder resin. That is, such a state that the monofunctional or bifunctional ester wax and the binder resin easily become compatible with each other is established, and hence the dispersibility of the monofunctional or bifunctional ester wax is improved. In addition, with regard to the hydrocarbon wax, when the hydrocarbon wax is used alone for a binder resin to be generally used in a toner, the releasability of the toner is improved, but part of the hydrocarbon wax is compatibilized with the binder resin, and hence the releasability of the hydrocarbon wax is not exerted to the maximum. However, when the monofunctional or bifunctional ester wax exists, the monofunctional or bifunctional ester wax having a large solubility in the binder resin is preferentially compatibilized with the binder resin, and hence the hydrocarbon wax having relatively high hydrophobicity easily forms a domain.

As described above, when the binder resin having a linear type molecular structure and reduced in molecular weight, and the monofunctional or bifunctional ester wax and the hydrocarbon wax with a controlled relationship between their solubilities in the binder resin exist, each toner component exists in a suitable state, and hence an improvement in fixability that has never been achieved before can be observed.

Accordingly, with regard to the toner, the monofunctional or bifunctional ester wax is dispersed in the toner, and the hydrocarbon wax can exist in such a state as to form a domain near the center of the toner. With such toner structure, upon reception of heat by the toner at the time of fixation, the plasticization of the toner mainly by the dispersion of the monofunctional or bifunctional ester wax in the binder resin is additionally promoted, and hence the toner is rapidly deformed.

Further, it has been elucidated that as a result of the deformation, the hydrocarbon wax present in the toner, the wax being present mainly as a domain, is easily extruded to the outside of the toner, the releasability of the toner is easily expressed, and the contamination of a fixing film is suppressed.

In addition, it has been elucidated that controlling the structure of the toner with such binder resin and release agents as described above additionally improves the dot reproducibility and the effect is sustained even at the time of the long-term use of the toner.

The foregoing can be achieved probably as described below. The molecular weight distribution and branched state of the binder resin, and the states of presence of the release agents are optimized, and hence the charged state of the toner is uniformized. Further, an image well consistent with a dot is obtained probably because of the following reason. The image can be fixed even under a light pressure at the time of the fixation, and hence the toner does not excessively squash at the time of the fixation.

In addition, the toner of the present invention has shown a good result concerning its developability after standing under a high-temperature, high-humidity environment as well. This is because of the following reason. Despite the fact that the binder resin with its molecular weight reduced is used, the combination of the binder resin having a small extent of branching with the release agent (a) and the release agent (b) results in an interaction among the binder resin, and the release agent (a) and the release agent (b) even under the high-temperature, high-humidity environment, and hence the storage stability of the toner is improved. Accordingly, a problem such as the exudation of the release agents and a low-molecular weight component in the binder resin to the surface of the toner hardly occurs even at the time of the standing under the high-temperature, high-humidity environment, and hence the toner can maintain good chargeability even after the standing under the high-temperature, high-humidity environment. Thus, the developability is improved.

The toner of the present invention has the monofunctional or bifunctional ester wax as the release agent (a). The monofunctional or bifunctional ester wax is an ester wax having a linear type molecular structure, and easily conforms to the binder resin having a linear type molecular structure. Accordingly, the monofunctional or bifunctional ester wax can be uniformly dispersed in the toner, and as a result, easily imparts the plasticity of the toner. On the other hand, an ester wax that is trifunctional or more is of a branched molecular structure because the wax has three or more ester bonds. Accordingly, its compatibilizing performance with respect to the binder resin having a linear type molecular structure is apt to reduce, and hence the wax is apt to be dispersed in the toner nonuniformly. As a result, the plasticity is apt to reduce. Further, the wax is less compatible with the resin upon its dissolution at the time of the fixation as well, and hence the plasticity reduces.

Here, the binder resin to be used in the present invention is preferably a styrene-based copolymer or polyester resin having a linear type molecular structure, particularly preferably a styrene-based copolymer using styrene as a main component. Further, when the resin is a styrene-based copolymer having a linear type molecular structure, the dispersed states of the monofunctional or bifunctional ester wax and the hydrocarbon wax are easily adjusted.

Next, the toner of the present invention has the hydrocarbon wax as the release agent (b). In general, hydrocarbon waxes having polarity is rare and the waxes have extremely high hydrophobicity, and hence any such wax easily forms a domain in the toner. Accordingly, when the toner is produced by, for example, a suspension polymerization method, the hydrocarbon wax easily forms a domain near the center of the toner.

Here, the presence of the release agent (a) having good compatibilizing performance with respect to the binder resin together with the release agent (b) like the present invention allows the release agent (b) having low compatibilizing performance with respect to the binder resin to further easily form a domain, and hence a toner structure suitable for the present invention can be achieved.

As described above, the hydrocarbon wax has low compatibilizing performance with respect to the binder resin, and hence the wax can exude from the toner at the time of its dissolution caused by heat of fixation to impart releasability from a fixing member. Accordingly, good fixation can be performed even in a light-pressure type fixing unit construction.

In the present invention, a solubility in the binder resin was used as an indicator of the conforming performance of any such release agent as described above to the binder resin.

That is, in the present invention, the solubility of the release agent (a) in the binder resin needs to be higher than the solubility of the release agent (b) in the binder resin. When the solubility of the release agent (a) in the binder resin is higher than the solubility of the release agent (b) in the binder resin, the release agent (a) easily comes compatible with the binder resin, and is hence brought into a state of being finely dispersed in the binder resin. Further, the release agent (b) hardly comes compatible with the binder resin relatively, and hence easily forms a domain.

Controlling the solubilities of the release agent (a) and the release agent (b) in the binder resin as described above enables the toner to sufficiently exert its releasability and plasticity.

Of such release agents a, a monofunctional or bifunctional ester wax having an acid value of 2 mgKOH/g or less and a peak top temperature of a maximum endothermic peak of 60° C. or more and 80° C. or less is particularly preferred. When the acid value is 2 mgKOH/g or less, the compatibilizing performance with respect to the binder resin is easily improved. In addition, in the case where the toner is produced in an aqueous medium, when the acid value is 2 mgKOH/g or less, the release agent (a) hardly exudes to the surface of the toner, and hence the storage stability and chargeability of the toner are easily improved.

When the peak top temperature of the maximum endothermic peak of the release agent (a) is 60° C. or more, the storage stability and the chargeability are further easily improved. In addition, when the peak top temperature is 80° C. or less, the low-temperature fixability is further easily improved.

It should be noted that the release agent (a) is preferably incorporated in an amount of 5 parts by mass or more and 20 parts by mass or less with respect to 100 parts by mass of the binder resin. In addition, the mass ratio between the contents of the release agent (a) and the release agent (b) (content of the release agent (a)/content of the release agent (b)) preferably falls within the range of 1/1 or more and 20/1 or less. In addition, the total content of the release agents in toner particles in the present invention is preferably 5 parts by mass or more and 40 parts by mass or less with respect to 100 parts by mass of the binder resin.

In addition, when the peak top temperature of the maximum endothermic peak of the release agent (a) and the peak top temperature of the maximum endothermic peak of the release agent (b) in the differential scanning calorimetry (which may hereinafter be referred to as "DSC") of the toner are represented by Tma (° C.) and Tmb (° C.), respectively, the relationship of $0 \leq (Tmb-Tma) \leq 5$ is preferably satisfied. When the relationship of $0 \leq (Tmb-Tma) \leq 5$ is satisfied, the monofunctional or bifunctional ester wax that largely contributes to the meltability of the toner easily melts prior to the hydrocarbon wax that easily contributes to the releasability. After that, the toner can exert the releasability. Accordingly, the low-temperature fixability and the releasability are easily improved. In addition, the case where the difference between the peak top temperature of the maximum endothermic peak of the hydrocarbon wax and the peak top temperature of the maximum endothermic peak of the monofunctional or bifunctional ester wax is 5° C. or less is preferred because the melting and the release easily occur at the same time.

It should be noted that a method involving melting the release agent (a) and the binder resin, and then gradually lowering their temperatures at the time of the production of the toner is preferred for establishing such a state that the release agent (a) and the binder resin are compatibilized with each other because of its simplicity. Specifically, the rate of temperature decrease in a cooling step for terminating a polymerization reaction step is preferably 10° C./min or less, more preferably 6° C./min or less, still more preferably 3° C./min or less. In addition, the toner particles are preferably produced in an aqueous medium from such a viewpoint that such cooling step is easily managed.

Next, it is important that the toner of the present invention be such that when the tetrahydrofuran-soluble components of the toner are subjected to measurement by gel permeation chromatography (GPC), the proportion of components having a molecular weight of 500 or less is 2.5 area % or less.

When the proportion of ultra-low-molecular weight components having a molecular weight of 500 or less in the tetrahydrofuran-soluble components of the toner is 2.5 area % or less, a difference between the local compatibilities of the release agent (a) in the binder resin becomes small, and hence such a tendency that the dispersibility of the release agent (a) in the toner becomes uniform and the fixability is improved is observed. Further, a reduction in the amount of the ultra-low-molecular weight component results in improvements in the chargeability, and the density and image quality of an image formed with the toner. In addition, a change over time of the ultra-low-molecular weight components and the like are eliminated, and hence the toner changes to a small extent at the time of its long-term use and can provide a high density and high image quality over a long time period. When the proportion of the components having a molecular weight of 500 or less is larger than 2.5 area %, the molecular weight distribution of the resin component of the binder resin as a whole enlarges, and hence the plasticization of the binder resin is apt to be nonuniform upon reception of heat at the time of fixation, and density unevenness and a fixation failure are apt to occur. In addition, the dispersibility of the release agent (a) reduces, and hence the plasticity tends to reduce additionally.

It should be noted that the proportion of the ultra-low-molecular weight components in the tetrahydrofuran-soluble components of the toner of the present invention was measured by gel permeation chromatography (GPC). On the other hand, the weight-average molecular weight Mw and the radius of gyration Rw are measured by size exclusion chromatography-multiangle laser light scattering (which may hereinafter be referred to as "SEC-MALLS"). The employment of size exclusion chromatography-multiangle laser light scattering (SEC-MALLS) can provide a detailed data on a molecular structure such as the radius of gyration Rw.

It should be noted that the setting of the proportion of the components having a molecular weight of 500 or less in the tetrahydrofuran-soluble components of the toner in the present invention to 2.5 area % or less can be achieved by changing the kind and amount of a polymerization initiator, and a reaction condition. The polymerization initiator is preferably, for example, such a kind as described below. The polymerization initiator has high reactivity and produces a single radical species upon its cleavage. When the reactivity is high, the polymerization reaction easily progresses, and hence the production of the ultra-low-molecular weight components is easily suppressed. In addition, in the case where only a single radical species is produced, a variation in reactivity hardly occurs as compared with that in the case where different radicals are produced, and hence the molecular weight of the resin is easily adjusted.

Next, it is important that the toner of the present invention be such that when the tetrahydrofuran-soluble components of the toner are subjected to measurement by size exclusion chromatography-multiangle laser light scattering (SEC-MALLS), the weight-average molecular weight Mw is 5,000 or more and 100,000 or less, and the ratio Rw/Mw between the weight-average molecular weight Mw and the radius of gyration Rw is $5.0\times10^{-4}$ or more and $1.0\times10^{-2}$ or less. A unit used for the radius of gyration is "nm".

Hereinafter, size exclusion chromatography-multiangle laser light scattering (SEC-MALLS) is described.

The abundance of each molecular size can be determined by measurement based on SEC (ordinary GPC). In contrast, in SEC-MALLS (apparatus obtained by coupling SEC as separating means and a multiangle light scattering detector), a more real molecular weight distribution which reflects a difference in molecular structure such as branching or crosslinking can be determined for a mixed sample formed of molecules of the same molecular size by utilizing light scattering. In addition, a mean square radius ($Rg^2$) that represents the extension per molecule can be determined. Thus, the molecular design of the toner can be accurately performed.

In a conventional SEC method, molecules to be subjected to measurement undergo a molecular sieve effect upon their passage through a column, and are then sequentially eluted in the order of decreasing molecular size. Thus, their molecular weights are measured. In this case, comparing a linear polymer and a branched polymer having an equal molecular weight, the former is eluted more quickly because the former has the larger molecular size in a solution. Therefore, the molecular weight of the branched polymer measured by the SEC method is measured to be smaller than its molecular weight obtained by the SEC-MALLS method.

On the other hand, the Rayleigh scattering of a molecule to be subjected to measurement was utilized in the light scattering method of the present invention.

A molecular weight even closer to the true molecular weight (absolute molecular weight) can be determined in each of all molecular forms, i.e., a linear polymer and a branched polymer, by measuring the dependencies of the intensity of scattered light on the incidence angle of light and a sample concentration, and analyzing the measured results by, for example, a Zimm method or a Berry method. In the present invention, the intensity of scattered light was measured by the SEC-MALLS measurement method, and a relationship represented by Zimm's equation below was analyzed by utilizing a Debye plot so that the weight-average molecular weight (Mw) and the mean square radius ($Rg^2$) based on the absolute molecular weight were derived. In addition, the Debye plot is a graph obtained by plotting $K\cdot C/R(\theta)$ indicated by the axis of ordinate against $\sin^2(\theta/2)$ indicated by the axis of abscissa, and an Mw (weight-average molecular weight) and a mean square radius $Rg^2$ can be calculated from the intercept of the axis of ordinate and the gradient at that time, respectively.

It should be noted that the number-average molecular weight Mn, the weight-average molecular weight Mw and mean square radius $Rg^2$ are calculated for each component of elution time. Accordingly, in order that the number-average molecular weight Mn, weight-average molecular weight Mw and mean square radius $Rg^2$ of the entire sample be calculated, each of their average values must be further calculated.

It should be noted that when measurement is performed with an apparatus to be described later, values for the number-average molecular weight (Mn), weight-average molecular weight (Mw), and radius of gyration (Rw) of the entire sample are obtained as direct outputs from the apparatus.

$$\frac{K\cdot C}{R(\theta)} = \frac{1}{Mw}\cdot\frac{1}{P(\theta)} \text{ Zimm's equation} \cong \frac{1}{Mw}\left[1+\langle Rg^2\rangle\sin^2\left(\frac{\theta}{2}\right)\cdot 16\pi^2/3\lambda^2\right] \quad \text{[Math. 1]}$$

$K$: Optical constant [Math. 2]

$C$: Concentration of polymer (g/mL)

$R(\theta)$: Relative intensity of scattered light at scattering angle $\theta$ $Mw$: Weight-average molecular weight $P(\theta)$: Factor that represents angle dependency of scattered light $$P(\theta) = R(\theta)/R_0 = 1 - \langle Rg^2\rangle[(4\Pi/\lambda)\sin(\theta/2)]^2/3$$

$\langle Rg^2\rangle$: Mean square radius $\lambda$: Wavelength of laser light in solution (nm)

Here, mean square radius $Rg^2$ is a value that generally represents the extension per molecule, and the value Rw/Mw given by dividing a root value of the radius of gyration Rw ($Rw=(Rg^2)^{1/2}$) by the Mw is taken to represent the degree of branching per molecule.

In other words, as the Rw/Mw reduces, the spread becomes smaller for the molecular weight, and hence the extent of branching of each molecule enlarges. In contrast, as the Rw/Mw increases, the spread becomes larger for the molecular weight, and hence the molecule is considered to be linear.

In the present invention, it is important that when the tetrahydrofuran-soluble components of the toner at 25° C. are subjected to measurement by SEC-MALLS, the weight-average molecular weight Mw be 5,000 or more and 100,000 or less, preferably 5,000 or more and 25,000 or less. That the weight-average molecular weight Mw is 100,000 or less means that the binder resin in the toner has a low molecular weight, and the combination of the resin with a specific release agent enables easy fixation even in a light-pressure type fixing unit construction. In addition, when the weight-average molecular weight Mw is 5,000 or more, the elasticity of the toner is maintained upon charging of the toner, and hence the toner is easily charged in a uniform fashion. In addition, an image density and image quality can be held at the time of its long-term use. When the weight-average molecular weight Mw is larger than 100,000, the toner hardly plasticizes, and hence its fixability deteriorates. In addition, the dispersibility of the release agent (a) is apt to reduce, and hence the fixation is apt to be further difficult. On the other hand, when the weight-average molecular weight Mw is smaller than 5,000, the elasticity of the toner is apt to reduce upon charging of the toner, and hence the charging is apt to be nonuniform. In addition, the toner is apt to be deformed at the time of its long-term use, and hence reductions in density and image quality are apt to occur.

Next, that the ratio Rw/Mw between the weight-average molecular weight Mw and radius of gyration Rw of the tetrahydrofuran-soluble components of the toner at 25° C. is $5.0\times10^{-4}$ or more and $1.0\times10^{-2}$ or less means that the binder resin in the toner has a linear type molecular structure. Accordingly, the dispersibility of each of the materials such as the release agent (a) in the toner is improved, and hence the fixability and the image quality at the time of the long-term use are easily improved.

In addition, an interaction between the binder resin and the release agent (a) strengthens. As a result, the storage stability of the toner under a high-temperature, high-humidity environment is improved, and the toner can maintain good developability even after having been left to stand under the high-temperature, high-humidity environment.

That the Rw/Mw is smaller than $5.0\times10^{-4}$ means that the binder resin has a branched type molecular structure. Accordingly, the dispersibility of each of the materials in the toner, in particular the monofunctional or bifunctional ester wax reduces. When the Rw/Mw is larger than $1.0\times10^{-2}$, it becomes difficult to produce the toner stably and image density unevenness is apt to occur at the time of the long-term use of the resultant toner.

It should be noted that the Rw/Mw is more preferably $2.0\times10^{-3}$ or more and $1.0\times10^{-2}$ or less. When the Rw/Mw falls within the range, the fixability, and the density and image quality at the time of the long-term use are further easily improved.

The radius of gyration Rw is preferably 20 or more and 70 or less. When the radius of gyration is 20 or more and 70 or less, the molecular weight of the binder resin is small, and hence its extent of branching is easily controlled.

In addition, when the tetrahydrofuran-soluble components of the toner at 25° C. are subjected to measurement by size exclusion chromatography-multiangle laser light scattering (SEC-MALLS), their number-average molecular weight Mn(25° C.) is preferably 500 or more and 3,000 or less, and the number-average molecular weight Mn is more preferably 1,000 or more and 2,500 or less. When the toner satisfies the requirement, the deformation of the toner can be properly controlled, and hence its low-temperature fixability is improved. In addition, its charging stability at the time of its long-term use becomes high, and hence the dot reproducibility is easily improved. Further, the storage stability is also improved.

In addition, in the present invention, even when the ratio (Mn(135° C.)/Mn(25° C.)) between the number-average molecular weight Mn(25° C.) when the tetrahydrofuran-soluble components of the toner at 25° C. are subjected to measurement by size exclusion chromatography-multiangle laser light scattering (SEC-MALLS) and the number-average molecular weight Mn(135° C.) when the o-dichlorobenzene-soluble components of the toner at 135° C. are subjected to measurement by size exclusion chromatography-multiangle laser light scattering (SEC-MALLS) is less than 25, an effect of the present invention can be obtained.

The weight-average molecular weight Mw, and the ratio Rw/Mw between the weight-average molecular weight Mw and the radius of gyration Rw can be adjusted by changing the kind and amount of a polymerization initiator, and a reaction condition as described later.

In addition, it is preferred that heat of fixation uniformly propagate through the toner in order that good fixation be realized in a light-pressure type fixing unit construction. To that end, the shape of the toner is preferably spherical. When the shape is spherical, the toner on paper is brought close to a close-packed one, and hence heat efficiency is easily improved.

In view of the foregoing, the toner preferably has an average circularity of 0.960 or more. When the average circularity of the toner is 0.960 or more, its thermal conductivity becomes uniform, and hence low-temperature fixation can be performed. As a result, density uniformity and the dot reproducibility are easily improved. Further, when the average circularity increases, the shear applied to the toner upon development easily becomes uniform, and hence the toner easily realizes a uniform density and high image quality over a long time period. In addition, even after the toner has been left to stand under a high-temperature, high-humidity environment, the toner has good flowability and good chargeability, and hence easily obtains good developability.

Next, an improvement in the flowability of the toner particles themselves is effective in reducing a change in the state of the surface of each of the toner particles at the time of their long-term use due to, for example, the embedment of an external additive. A total energy measured with a powder flowability analyzer when the agitation rate is 100 mm/sec is given as an indicator of the flowability of the toner particles.

The toner of the present invention is preferably such that the total energy of the toner particles measured with a powder flowability analyzer when the agitation rate is 100 mm/sec is 500 mJ or more and 1,000 mJ or less. A total energy of 500 mJ or more is preferred because the triboelectric chargeability of the toner is easily improved. Meanwhile, a total energy of 1,000 mJ or less is preferred because the flowability is improved. When the total energy is 500 mJ or more and 1,000 mJ or less, a balance can be established between the triboelectric chargeability and the flowability by such reasons. Accordingly, the toner easily holds a high image density and high image quality even upon embedment of, for example, an external additive at the time of its long-term use. Therefore, such total energy is preferred.

Providing the surface of each toner particle with a strong outer shell is effective in enhancing the flowability of such toner particles themselves and improving their storage stability. The presence of the outer shell increases the hardness of each particle, thereby enhancing the flowability. In addition, the presence of the outer shell can suppress the embedment of an external additive, and hence an improvement in the stress resistance of the toner and reductions in the variations of the characteristics of the toner at the time of its long-term use can be realized.

In addition, it has been important for the outer shell to suppress a variation in covered state among toner particles and to uniformly cover each particle so that the exposure of the binder resin be prevented. In the case where the toner is produced by, for example, a wet process, simply mixing a material serving as the outer shell to form the toner particles or simply adding the outer shell material after the formation of a core does not suffice for the formation of such outer shell, and a correlation with the binder resin needs to be controlled. In other words, the outer shell material does not uniformly cover the toner surface or the outer shell does not have a moderate thickness until the weight-average molecular weight Mw and the radius of gyration Rw are adjusted, and the kind and amount of the outer shell agent are controlled. Accordingly, a uniform, strong outer shell can be formed by such adjustment and control. As a result of the formation, the toner characteristics that satisfy the present invention can be exhibited. That is, an image having a high image density and high dot reproducibility can be obtained over a long time period. In addition, the low-temperature fixability can be improved.

The kind of such outer shell agent is preferably a polyester resin, particularly preferably a polyester obtained by polycondensation with a titanium-based catalyst. The polyester obtained by polycondensation with a titanium-based catalyst is preferred because the polyester easily becomes homogeneous and hence easily covers the surface of each toner particle in a uniform fashion.

In addition, when the homogeneous polyester, and the binder resin having a low molecular weight and a linear type molecular structure of the present invention are combined with each other, upon formation of the toner particles in a low-viscosity state such as a polymerizable monomer like, for example, suspension polymerization, sufficient molecular motion is possible, and hence the outer shell covers the surface more uniformly.

The content of the polyester resin is preferably 7 parts by mass or more and 30 parts by mass or less with respect to 100 parts by mass of the binder resin. When the content of the polyester resin is 7 parts by mass or more, the flowability of the toner particles is easily improved. In addition, when the content of the polyester resin is 30 parts by mass or less, the dispersibility of a release agent, a coloring agent, or the like is easily improved, and hence the low-temperature fixability is improved.

Next, the binder resin of the present invention preferably uses, as a main component, a resin obtained by polymerization with a peroxydicarbonate as a polymerization initiator. When the binder resin is produced by, for example, radical polymerization, the use of the peroxydicarbonate as the polymerization initiator results in the production of two carbonate radicals of the same kind upon its cleavage. In addition, a carbonate radical hardly causes a decarboxylation reaction. As a result, radicals of the same kind easily exist in a reaction system, and hence the radical polymerization of a polymerizable monomer can be efficiently initiated. Accordingly, the molecular weight of the binder resin can be reduced by using the initiator in a smaller amount than that of a conventional peroxide type polymerization initiator. Further, the case where the molecular weight can be reduced by using the initiator in the smaller amount is preferred because a side reaction and the like hardly occur and hence a linear type molecular structure is easily produced.

When the binder resin of the present invention is produced by radical polymerization, the polymerization initiator is preferably used at a temperature higher than its 10-hour halflife temperature by 15° C. or more. When the polymerization initiator is used at a temperature higher than its 10-hour halflife temperature by 15° C. or more, the cleavage of the polymerization initiator becomes rapid, and hence the reduction in the molecular weight is easily attained. In addition, radicals of the same kind are easily produced in the reaction system, and hence a side reaction hardly occurs. Accordingly, a binder resin having a linear type molecular structure is easily produced.

With regard to a method of adding the polymerization initiator, the polymerization initiator can be added collectively or dividedly.

Examples of the binder resin to be used in the toner of the present invention include: homopolymers of styrene and substituted derivatives thereof, such as polystyrene and polyvinyl toluene; styrene-based copolymers such as a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer, and a styrene-maleic acid ester copolymer; and polymethyl methacrylate, polybutyl methacrylate, polyvinyl acetate, polyethylene, polypropylene, polyvinylbutyral, a silicone resin, a polyester resin, a polyamide resin, an epoxy resin, and a polyacrylic acid resin. Those may be used alone or in combination of multiple kinds thereof. Of those, a styrene-based copolymer using styrene as a main component is particularly preferred in terms of, for example, developing characteristic and fixability, and a styrene-alkyl acrylate-based copolymer or a styrene-alkyl methacrylate-based copolymer is more preferably used as a main component. When any such copolymer is used, the binder resin is easily provided with a linear type molecular structure, and the states of presence of the release agent (a) and the release agent (b) are easily made suitable.

In the toner of the present invention, in order to improve the charging characteristics, a charge control agent may be blended as required. A known agent can be utilized as the charge control agent, and a charge control agent that can quickly cause charging and can stably maintain a certain charge quantity is particularly preferred. Further, when the toner is produced by a polymerization method as described later, a charge control agent which has low polymerization-inhibiting property and is substantially free of any soluble matter in the aqueous medium is particularly preferred. Specific compounds as negative-type charge control agents out of the charge control agents can be exemplified by metal compounds of aromatic carboxylic acids such as salicylic acid, an alkylsalicylic acid, a dialkylsalicylic acid, naphthoic acid, and dicarboxylic acids; metal salts and metal complexes of azo dyes and azo pigments; polymer compounds each having a sulfonic acid group or carboxylic acid group in a side chain position; boron compounds; urea compounds; silicon compounds; and calixarenes. Positive-type charge control agents can be exemplified by quaternary ammonium salts, polymer compounds each having any of the quaternary ammonium salts in a side chain position, guanidine compounds, nigrosin-based compounds, and imidazole compounds.

Generally employed as a method of incorporating the charge control agent into the toner is a method involving adding the charge control agent to the inside of each toner particle or, when the toner is produced by suspension polymerization, a method involving adding the charge control agent into a polymerizable monomer composition before granulation. Alternatively, the surface of the toner can be uniformly covered by performing seed polymerization as described below. A polymerizable monomer in which the charge control agent is dissolved or suspended is added during the performance of polymerization through the formation of an oil droplet in water or after the polymerization. Alternatively, when an organometallic compound is used as the charge control agent, such compound can be introduced by adding the compound to each toner particle and applying a shear to mix and agitate the contents.

The usage of such charge control agent is determined by the kind of the binder resin, the presence or absence of any other additive, and the production method for the toner including a dispersion method, and is hence not uniquely limited. However, when the charge control agent is internally added to each toner particle, the charge control agent is used in an amount in the range of preferably 0.1 part by mass or more and 10 parts by mass or less, more preferably 0.1 part by mass or more and 5 parts by mass or less with respect to 100 parts by mass of the binder resin. In addition, when the charge control agent is externally added to each toner particle, the amount is preferably 0.005 part by mass or more and 1.0 part by mass or less, more preferably 0.01 part by mass or more and 0.3 part by mass or less with respect to 100 parts by mass of the toner.

The toner of the present invention contains a coloring agent suited for a target tint. A known organic pigment or dye, carbon black, a magnetic substance, and the like can each be used as the coloring agent to be used in the toner of the present invention.

Specifically, there can be used, as cyan coloring agents, copper phthalocyanine compounds and derivatives thereof, anthraquinone compounds, and basic dye lake compounds. Specific examples thereof include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue 66.

There are used, as magenta coloring agents, condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples thereof include C.I. Pigment Red 2, C.I. Pigment Red 3, C.I. Pigment Red 5, C.I. Pigment Red 6, C.I. Pigment Red 7, C. I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

There are used, as yellow coloring agents, compounds typified by condensed azo compounds, isoindolinone compounds, anthraquinone compounds, azo metal complexes, methine compounds, and acrylamide compounds. Specific examples thereof include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191, and C.I. Pigment Yellow 194.

Those coloring agents may be used alone, or as a mixture or solid solution of two or more kinds thereof. The coloring agent used in the toner of the present invention is appropriately selected in view of hue angle, chroma, saturation, brightness, lightfastness, OHP transmissivity, and dispersibility in toner. In addition, the addition amount of the coloring agent is preferably 1 part by mass or more and 20 parts by mass or less with respect to 100 parts by mass of the binder resin.

Further, there are utilized, as black coloring agents, carbon black, a magnetic substance, and one toned to black by using the above-mentioned yellow/magenta/cyan coloring agents. When the carbon black is used as a black coloring agent, its addition amount is preferably 1 part by mass or more and 20 parts by mass or less with respect to 100 parts by mass of the binder resin.

In addition, when the toner of the present invention is used as a magnetic toner, a magnetic substance can also be used as the coloring agent. When a magnetic substance is used as a black coloring agent, the addition amount of the magnetic substance is preferably 20 parts by mass or more and 150 parts by mass or less with respect to 100 parts by mass of the binder resin.

When the addition amount of the magnetic substance is 20 parts by mass or more, the toner has high coloring power and fogging is easily suppressed. In addition, when the addition amount is 150 parts by mass or less, the endotherm of the magnetic substance reduces, and hence the fixability is more likely to be improved.

It should be noted that the content of the magnetic substance in the toner can be measured with a thermal analyzer TGA7 manufactured by PerkinElmer Co., Ltd. A method for the measurement is as described below. Under a nitrogen atmosphere, the toner is heated from normal temperature to 900° C. at a heating rate of 25° C./min. The loss (mass %) in the range of 100° C. to 750° C. is defined as the amount of the binder resin, and the remaining mass is approximately defined as the amount of the magnetic substance.

When the toner is produced by employing a polymerization method in the present invention, attention should be paid to the polymerization-inhibiting property and aqueous phase-migrating property of the coloring agent. In view of the foregoing, the coloring agent is desirably subjected to surface modification such as a hydrophobic treatment with a substance that does not inhibit any polymerization. Particular attention should be paid to dyes and carbon black upon their use because many of the dyes and the carbon black have polymerization-inhibiting properties.

The carbon black may be treated with a substance that reacts with a surface functional group of the carbon black such as polyorganosiloxane.

When the magnetic substance is used in the toner of the present invention, the magnetic substance uses a magnetic iron oxide such as triiron tetroxide or γ-iron oxide as a main component, and may contain an element such as phosphorus, cobalt, nickel, copper, magnesium, manganese, aluminum, or silicon. Any such magnetic substance has a BET specific surface area by nitrogen adsorption of preferably 2 $m^2/g$ or more and 30 $m^2/g$ or less, more preferably 3 $m^2/g$ or more and 28 $m^2/g$ or less. Further, the magnetic substance preferably has a Mohs hardness of 5 or more and 7 or less. Examples of the shape of the magnetic substance include a polyhedral shape, an octahedral shape, a hexahedral shape, a spherical shape, a needle shape, and a scaly shape. The magnetic substance preferably has a shape with a low degree of anisotropy, such as a polyhedral shape, an octahedral shape, a hexahedral shape, or a spherical shape in order to increase image density.

The magnetic substance preferably has a volume-average particle diameter (Dv) of 0.10 μm or more and 0.40 μm or less. When the volume-average particle diameter (Dv) is 0.10 μm or more, the particles of the magnetic substance hardly agglomerate, and hence the uniform dispersibility of the magnetic substance in the toner is improved. In addition, the magnetic substance having a volume-average particle diameter (Dv) of 0.40 μm or less is preferably used because the coloring power of the toner is improved.

It should be noted that the volume-average particle diameter (Dv) of the magnetic substance can be measured with a transmission electron microscope. Specifically, the toner particles to be observed are sufficiently dispersed in an epoxy resin, and then the resultant is cured in an atmosphere having a temperature of 40° C. for 2 days so that a cured product be obtained. The resultant cured product is turned into a flaky sample with a microtome, and then the sample is photographed with a transmission electron microscope (TEM) at a magnification of 10,000 to 40,000. The diameters of 100 magnetic substance particles in the field of view of the photograph are measured. Then, the volume-average particle diameter (Dv) is calculated on the basis of the equivalent diameter of a circle equal in area to the projected area of the magnetic substance. Alternatively, the particle diameters can be measured with an image analyzer.

The magnetic substance to be used in the toner of the present invention can be produced by, for example, the following method. An alkali such as sodium hydroxide is added to an aqueous solution of a ferrous salt in an equivalent or more with respect to the iron component so that an aqueous solution containing ferrous hydroxide be prepared. While the pH of the prepared aqueous solution is maintained at 7 or more, air is blown into the aqueous solution. Then, the oxidation reaction of ferrous hydroxide is performed while the aqueous solution is heated to 70° C. or more. Thus, a seed crystal serving as the core of a magnetic iron oxide powder is produced first.

Next, an aqueous solution containing about one equivalent of ferrous sulfate with reference to the addition amount of the alkali previously added is added to the slurry liquid containing the seed crystal. While the pH of the resultant liquid is maintained at 5 to 10, air is blown into the liquid. During the blowing, the reaction of ferrous hydroxide is advanced so that the magnetic iron oxide powder be grown with the seed crystal as a core. At this time, the shape and magnetic characteristics of the magnetic substance can be controlled by selecting an arbitrary pH, an arbitrary reaction temperature, and an arbitrary agitation condition. As the oxidation reaction progresses, the pH of the liquid shifts to acidic values. However, the pH of the liquid is preferably prevented from becoming less than 5. The magnetic substance thus obtained is filtrated, washed, and dried by ordinary methods. Thus, the magnetic substance can be obtained.

In addition, when the toner is produced by a polymerization method in the present invention, the surface of the magnetic substance is extremely preferably subjected to a hydrophobic treatment. When the surface is treated by a dry process, the magnetic substance that has been washed, filtrated, and dried is treated with a coupling agent. When the surface is treated by a wet process, the dried product after the termination of the oxidation reaction is re-dispersed, or the iron oxide body obtained by the washing and filtration after the termination of the oxidation reaction is re-dispersed in another aqueous medium without being dried, followed by a coupling treatment. Specifically, the coupling treatment is performed by adding a silane coupling agent while sufficiently agitating the re-dispersion liquid, and hydrolyzing the agent and then increasing the temperature of the re-dispersion liquid or hydrolyzing the agent and then adjusting the pH of the dispersion liquid to an alkali region. The surface treatment is preferably performed by the following method out of such methods as described above from such a viewpoint that the surface treatment is uniformly performed. After the termination of the oxidation reaction, the resultant is filtrated and washed, and is then directly turned into slurry without being dried.

In order that the surface treatment of the magnetic substance be performed by the wet process, that is, the magnetic substance be treated with a coupling agent in an aqueous medium, first, the magnetic substance is sufficiently dispersed in the aqueous medium so as to have a primary particle diameter, and then the dispersion liquid is agitated with an agitation blade or the like lest the particles of the magnetic substance should precipitate or agglomerate. Next, an arbitrary amount of the coupling agent is added into the above-mentioned dispersion liquid, and then the surface treatment is performed while the coupling agent is hydrolyzed. At this time as well, it is more preferred that the surface treatment be performed while the magnetic substance is sufficiently dispersed with an apparatus such as a pin mill or a line mill lest the agglomeration should occur during the performance of the agitation.

The term "aqueous medium" as used herein refers to a medium mainly formed of water. Specific examples thereof include water itself, a medium obtained by adding a small amount of a surfactant to water, a medium obtained by adding a pH adjustor to water, and a medium obtained by adding an organic solvent to water. A nonionic surfactant such as polyvinyl alcohol is preferably used as the surfactant. The surfactant is preferably added in an amount of 0.1 to 5.0 mass % with respect to water. Examples of the pH adjustor include inorganic acids such as hydrochloric acid. Examples of the organic solvent include alcohols.

As a coupling agent that can be used for a surface treatment of the magnetic substance in the present invention, a silane coupling agent and a titanium coupling agent are given, for example. Of those, more preferably used is a silane coupling agent which is represented by the general formula (1).

$$R_mSiY_n \qquad \text{general formula (1)}$$

(In the formula, R represents an alkoxy group, m represents an integer of 1 to 3, Y represents a functional group such as an alkyl group, a vinyl group, an epoxy group, an acrylic group, or a methacrylic group, and n represents an integer of 1 to 3, provided that m+n=4.)

Examples of the silane coupling agent represented by the general formula (1) may include vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hyroxypropyltrimethoxysilane, n-hexadecyltrimethoxysilane, and n-octadecyltrimethoxysilane.

Of those, an alkyltrialkoxysilane coupling agent represented by the following general formula (2) is preferably used from such a viewpoint that high hydrophobicity is imparted to the magnetic substance.

$$C_pH_{2p+1}—Si—(OC_qH_{2q+1})_3 \qquad \text{General formula (2)}$$

(In the formula, p represents an integer of 2 to 20 and q represents an integer of 1 to 3.)

It is preferred to use an alkyltrialkoxysilane coupling agent represented by the above-mentioned formula, where p represents an integer of 2 to 20 (more preferably an integer of 3 to 15) and q represents an integer of 1 to 3 (more preferably an integer of 1 or 2).

When the above-mentioned silane coupling agent is used, the magnetic substance can be treated with one kind of such agent alone, or can be treated with multiple kinds thereof in combination. When multiple kinds thereof are used in combination, the magnetic substance may be treated with each of the coupling agents individually, or may be treated with the agents simultaneously.

The total treatment amount of the coupling agent to be used is preferably 0.9 part by mass or more and 3.0 parts by mass or less with respect to 100 parts by mass of the magnetic substance, and it is important that the amount of the treatment agent be adjusted depending on, for example, the surface area of the magnetic substance and the reactivity of the coupling agent.

In the present invention, a coloring agent other than the magnetic substance may be used together. Examples of the coloring agent that can be used together include, in addition to the above-mentioned known dyes and pigments, magnetic or non-magnetic inorganic compounds. Specific examples thereof include ferromagnetic metal particles such as cobalt and nickel, alloys thereof obtained by adding chromium, manganese, copper, zinc, aluminum, rare-earth elements, and the like thereto, particles such as hematite, titanium black and nigrosine dyes/pigments, carbon black, and phthalocyanine. Those are also preferably used after being subjected to a surface treatment.

The toner preferably has a weight-average particle diameter (D4) of 5.0 μm or more and 9.0 μm or less in order that sufficient image characteristics be obtained. When the weight-average particle diameter (D4) is 5.0 μm or more, regulation with a developing blade easily becomes sufficient, and hence the toner is easily uniformly charged. In addition, when the weight-average particle diameter (D4) is 9.0 μm or less, dot reproducibility is easily improved, and hence a high-definition image is easily obtained.

The toner of the present invention preferably has a glass transition temperature (Tg) of 40° C. or more and 70° C. or less. When the glass transition temperature is 40° C. or more, the storage stability is improved and the toner hardly deteriorates even after its long-term use. In addition, when the glass transition temperature is 70° C. or less, the fixability is improved. Accordingly, the glass transition temperature of the toner is preferably 40° C. or more and 70° C. or less in consideration of a balance among its fixability, storage stability, and developability.

The toner of the present invention preferably has a core-shell structure for improving its image stability at the time of its long-term use. This is because the presence of a shell layer (outer shell) uniformizes the surface property of the toner, improves the flowability, and uniformizes the chargeability.

In addition, the shell as a high-molecular weight body uniformly covers the surface layer, and hence the exudation of the release agents and the like hardly occur even after long-term storage of the toner and the storage stability is improved.

Accordingly, an amorphous high-molecular weight body is preferably used in the shell layer, and its acid value is preferably 1.0 mgKOH/g or more and 20.0 mgKOH/g or less from the viewpoint of charging stability. When the acid value of the high-molecular weight body to be used in the shell layer is 20.0 mgKOH/g or less, the chargeability of the toner is easily stabilized, and hence its developability particularly under a high-temperature, high-humidity environment is improved. In addition, when the acid value of the high-molecular weight body to be used in the shell layer is 1.0 mgKOH/g or more, a robust shell is easily formed, and hence the storage stability is additionally improved.

With regard to a specific approach for forming the shell, the shell layer can be formed by embedding fine particles for the shell in core particles or, when the toner is produced in an aqueous medium according to the production method suitable for the present invention, causing ultra-fine particles for the shell to adhere to the core particles and drying the resultant. In addition, in a dissolution suspension method or the suspension polymerization method, the shell can be formed by causing the high-molecular weight body for the shell to be unevenly distributed at an interface with water, i.e., in the vicinity of the surface of the toner by means of the acid value and hydrophilicity of such high-molecular weight body. Further, the shell can be formed by swelling a monomer on the surface of each core particle and polymerizing the monomer by the so-called seed polymerization method.

Examples of the high-molecular weight body for the shell layer include: homopolymers of styrene and substituted derivatives thereof, such as polystyrene and polyvinyl toluene; styrene-based copolymers such as a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer, and a styrene-maleic acid ester copolymer; and polymethyl methacrylate, polybutyl methacrylate, polyvinyl acetate, polyethylene, polypropylene, polyvinylbutyral, a silicone resin, a polyester resin, a styrene-polyester copolymer, a polyacrylate-polyester copolymer, a polymethacrylate-polyester copolymer, a polyamide resin, an epoxy resin, a polyacrylic acid resin, a terpene resin, and a phenol resin. Those may be used alone or as a mixture of two or more kinds thereof. Further, a functional group may be introduced into any such polymer, such as an amino group, a carboxyl group, a hydroxyl group, a sulfonic acid group, a glycidyl group, or a nitrile group.

Of those resins, a polyester is preferred as described in the foregoing.

One or both of a saturated polyester resin and an unsaturated polyester resin which are appropriately selected can be used as the polyester resin to be used in the present invention.

An ordinary resin formed of an alcohol component and an acid component can be used as the polyester resin to be used in the present invention, and examples of both the components are given below.

Examples of the alcohol component include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexanedimethanol, butenediol, octenediol, cyclohexenedimethanol, hydrogenated bisphenol A, a bisphenol derivative represented by the formula (I):

[Chem. 1]

(I)

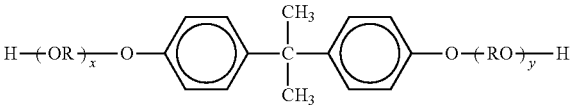

(in the formula, R represents an ethylene or propylene group, x and y each represent an integer of 1 or more, and the average of x+y is 2 to 10)

or a hydrogenated product of the compound represented by the formula (I), and a diol represented by the formula (II):

[Chem. 2]

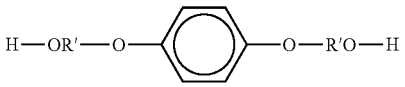

(II)

(in the formula, R' represents —$CH_2CH_2$—, —$CH_2$—CH($CH_3$)—, or —$CH_2$—C($CH_3$)$_2$—)
or a diol of a hydrogenated product of the compound represented by the formula (II).

As a divalent carboxylic acid, there are given: benzenedicarboxylic acids and anhydrides thereof, such as phthalic acid, terephthalic acid, isophthalic acid, and phthalic anhydride; alkyldicarboxylic acids and anhydrides thereof, such as succinic acid, adipic acid, sebacic acid, and azelaic acid; succinic acid substituted with an alkyl or alkenyl group having 6 to 18 carbon atoms and an anhydride thereof; and unsaturated dicarboxylic acids and anhydrides thereof, such as fumaric acid, maleic acid, citraconic acid, and itaconic acid; and the like.

Further examples of the alcohol component include polyhydric alcohols such as glycerin, pentaerythritol, sorbit, sorbitan, and an oxyalkylene ether of a novolak type phenol resin. Further examples of the acid component include polyvalent carboxylic acids such as trimellitic acid, pyromellitic acid, 1,2,3,4-butanetetracarboxylic acid, and benzophenonetetracarboxylic acid, and anhydrides thereof.

Of the above-mentioned polyester resins, the alkylene oxide adduct of bisphenol A which is excellent in charging characteristic and environmental stability, and other electrophotographic characteristics of which are balanced is preferably used. In the case of such compound, the average number of moles of the added alkylene oxide is preferably 2 or more and 10 or less in terms of the fixability and the durability of the toner.

It is preferred that the alcohol component account for 45 mol % or more and 55 mol % or less of all components of the polyester resin in the present invention, and the acid component account for 45 mol % or more and 55 mol % or less thereof.

Although the polyester resin in the present invention can be produced with any one of the catalysts such as a tin-based catalyst, an antimony-based catalyst, and a titanium-based catalyst, the titanium-based catalyst is preferably used as described in the foregoing.

In addition, a high-molecular weight body having a number-average molecular weight of 2,500 or more and 25,000 or less is preferably used as the high-molecular weight body that forms the shell. When the number-average molecular weight is 2,500 or more, the developability, blocking resistance, and durability of the toner are improved. In addition, a number-average molecular weight of 25,000 or less is preferred because the low-temperature fixability is improved. It should be noted that the number-average molecular weight can be measured by GPC.

Next, specific examples of the monofunctional or bifunctional ester include: waxes each having a fatty acid ester as a main component, such as a carnauba wax and a montanic acid ester wax; and those obtained by subjecting part or the whole of the acid components of fatty acid esters to deacidification, such as a deacidified carnauba wax; methyl ester compounds each having a hydroxyl group obtained by hydrogenation of vegetable fats and oils; saturated fatty acid monoesters such as stearyl stearate and behenyl behenate; diesterfied products of saturated aliphatic dicarboxylic acids and saturated aliphatic alcohols, such as dibehenyl sebacate, distearyl decanedioate, and distearyl octadecanedioate; and diesterfied products of saturated aliphatic diols and saturated fatty acids, such as nonanediol dibehenate and dodecanediol distearate.

Of those, saturated fatty acid monoesters and diesterified products are preferably used.

The release agent (a) can be used in an amount in the range of 5 parts by mass or more and 20 parts by mass or less with respect to 100 parts by mass of the binder resin. When the amount falls within the range of 5 parts by mass or more and 20 parts by mass or less, the dispersibility in the binder resin is improved, and hence the fixability and development stability at the time of the long-term use are improved.

Next, as a hydrocarbon wax, there may be used, specifically: aliphatic hydrocarbon-based waxes such as low-molecular weight polyethylene, low-molecular weight polypropylene, a microcrystalline wax, a paraffin wax, and a Fischer-Tropsch wax; oxides of aliphatic hydrocarbon-based waxes such as a polyethylene oxide wax or block copolymers thereof; and waxes obtained by grafting aliphatic hydrocarbon-based waxes with vinyl-based monomers such as styrene and acrylic acid, for example. Of those, a paraffin wax or a Fischer-Tropsch wax is preferably used in the range of 0.1 part by mass or more and 20 parts by mass or less with respect to 100 parts by mass of the binder resin.

The release agent (a) and the release agent (b) each preferably have a maximum endothermic peak in a region of 60° C. or more and 85° C. or less during heating in a DSC curve measured with a differential scanning calorimeter. The presence of the maximum endothermic peak in the above-mentioned temperature region improves the low-temperature fixability and the development stability. In addition, upon production of the toner particles by the suspension polymerization method as a method of producing toner particles suitable for the present invention, the dispersed state of each release agent is easily controlled to a desired one because its solubility in a polymerizable monomer is improved.

In the present invention, in addition to the release agent (a) and the release agent (b), any known wax may be added. Specific examples thereof include: saturated linear fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; fatty acid amides such as linoleic acid amide, oleic acid amide, and lauric acid amide; saturated fatty acid bisamides such as methylenebis(stearic acid amide), ethylenebis(capric acid amide), ethylenebis(lauric acid amide), and hexamethylenebis(stearic acid amide); unsaturated fatty acid amides such as ethylenebis(oleic acid amide), hexamethylenebis(oleic acid amide), N,N'-dioleyl adipic acid amide, and N,N'-dioleyl sebacic acid amide; aromatic bisamides such as m-xylenebis(stearic acid amide) and N,N'-distearyl isophthalic acid amide; aliphatic metal salts (generally referred to as metal soaps) such as calcium stearate, calcium laurate, zinc stearate, and magnesium stearate; and long-chain alkyl alcohols or long-chain alkyl carboxylic acids each having 12 or more carbon atoms.

The toner of the present invention is a toner comprising toner particles, each of which contains the binder resin, the coloring agent, the release agent (a), and the release agent (b), and can be produced by any one of the known methods. First, when the toner is produced by a pulverization method, components needed for the toner such as the binder resin, the coloring agent, the release agent (a), the release agent (b), and the charge control agent, any other additive, and the like are sufficiently mixed with a mixer such as a Henschel mixer or a ball mill. After that, the mixture is melted and kneaded with a heat kneader such as a heat roll, a kneader, or an extruder so that the toner materials may be dispersed or dissolved. Then, the resultant is cooled to solidify and pulverized. After that, the pulverized products are classified, and as required, subjected to a surface treatment. Thus, the toner particles can be obtained. The dispersed states of the release agent (a) and the release agent (b) in the binder resin can be adjusted by controlling temperature and kneading conditions at the time of the melt kneading. In addition, it does not matter which one of the classification and the surface treatment is performed prior to the other. In the classifying step, a multi-division classifier is preferably used in terms of production efficiency.

The pulverizing step can be performed by a method involving using a known pulverizing apparatus such as a mechanical impact type or jet type pulverizing apparatus. In addition, in order that the toner having a preferred circularity of the present invention be obtained, it is preferred that the pulverized products be further pulverized by applying heat or a treatment involving additionally applying a mechanical impact in an auxiliary fashion be performed. Alternatively, a hot water bath method involving dispersing finely pulverized toner particles (classified as required) in hot water, a method involving passing the particles through a heat air current, or the like may be employed.

For example, a method involving using a mechanical impact type pulverizer such as a Kryptron system manufactured by Kawasaki Heavy Industries Co. or a Turbo mill manufactured by Turbo Kogyo Co., Ltd. is given as means for applying a mechanical impact force. Also given is a method involving pressing the toner against the inside of a casing with a blade rotating at a high speed by means of a centrifugal force and applying a mechanical impact force to the toner by means of a force such as a compressive force or a frictional force like an apparatus such as a Mechanofusion System manufactured by Hosokawa Micron Corporation or a Hybridization System manufactured by NARA MACHINERY CO., LTD. A Meteorainbow (manufactured by Nippon Pneumatic Mfg. Co., Ltd.) is given as means for passing the particles through a heat air current.

Although the toner of the present invention can be produced by the pulverization method as described above, the toner particles obtained by the pulverization method are generally amorphous. Accordingly, a mechanical or thermal treatment, or any special treatment needs to be performed for obtaining the uniform chargeability of the present invention, and hence productivity deteriorates. In view of the foregoing, the toner of the present invention is preferably produced in an aqueous medium like, for example, a dispersion polymerization method, an association agglomeration method, a dissolution suspension method, or a suspension polymerization method. When the toner is produced in the aqueous medium, the binder resin as a feature of the present invention is optimized. Further, the selection of a suitable release agent enables one to easily obtain a toner with its structure highly controlled.

In particular, in the suspension polymerization method, the toner is produced from a polymerizable monomer. Accordingly, a liquid viscosity at an initial stage of the production is easily reduced, and hence the states of presence of the coloring agent and the release agents are easily adjusted. Further, the shapes of the toner particles are easily uniformized, and hence physical properties suitable for the present invention are easily satisfied. For example, uniform charging of the toner is easily attained or heat is easily applied to the toner in a uniform fashion at the time of fixation. Accordingly, the method is extremely preferred.

The suspension polymerization method involves: uniformly dissolving or dispersing the polymerizable monomer and the coloring agent (and a polymerization initiator, a crosslinking agent, the charge control agent, and any other additive as required) to provide a polymerizable monomer composition; and dispersing the polymerizable monomer composition in a continuous layer (such as an aqueous phase) containing a dispersion stabilizer with a proper agitator and performing a polymerization reaction simultaneously with the dispersion to provide a toner having a desired particle diameter. The toner obtained by the suspension polymerization method (which may hereinafter be referred to as "polymerized toner") is such that the shapes of individual toner particles are uniformized so as to be substantially spherical. Accordingly, a toner that satisfies physical property requirements suitable for the present invention such as the uniform chargeability and the dispersibility of the coloring agent is easily obtained.

In the production of the polymerized toner according to the present invention, examples of the polymerizable monomer that constructs the polymerizable monomer composition include the following monomers.

Examples of the polymerizable monomer include: styrene-based monomers such as styrene, o-methylstyrene, m-methylstyrene, p-methylstyrene, p-methoxystyrene, and p-ethylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and other monomers such as acrylonitrile, methacrylonitrile, and acrylamide. Those monomers may be used alone or in admixture with each other. Of the above-mentioned monomers, the use of styrene or a styrene derivative alone or in admixture with any other monomer is preferred in terms of ease of controlling the toner structure and ease of improving the developing performance and durability of the toner. In particular, the use of styrene and an alkyl acrylate, or styrene and an alkyl methacrylate as main components is more preferred.

The polymerization initiator to be used in the production of the toner of the present invention by a polymerization method preferably has a half-life of 0.5 hour or more and 30 hours or less in a polymerization reaction. Further, when the polymerization reaction is conducted with the polymerization initiator added in an amount of 0.5 part by mass or more and 20 parts by mass or less with respect to 100 parts by mass of the polymerizable monomer, a polymer having the maximum molecular weight in the range of 5,000 or more and 50,000 or less is obtained. Thus, preferred strength and suitable solubility characteristics for the toner can be given.

In addition, with regard to a polymerization reaction temperature, the polymerization reaction is preferably performed at a temperature higher than the 10-hour halflife temperature of the polymerization initiator by 15° C. or more and 35° C. or less. When the polymerization reaction is performed at a temperature higher than the 10-hour halflife temperature by 15° C. or more and 35° C. or less, the polymerization reaction is promoted, and hence excessive branching or crosslinking of the binder resin is easily suppressed.

Specific examples of the polymerization initiator include: azo-based or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-based polymerization initiators such as benzoyl peroxide, methyl ethyl ketone peroxide, diisopropyl peroxydicarbonate, cumene hydroperoxide, 2,4-dichlorobenzoyl peroxide, lauroyl peroxide, t-butyl peroxy-2-ethylhexanoate, t-butyl peroxypivalate, di(2-ethylhexyl) peroxydicarbonate, and di(sec-butyl)peroxydicarbonate. Of those, di(2-ethylhexyl)peroxydicarbonate and di(sec-butyl) peroxydicarbonate which are of a peroxydicarbonate type are preferably used because, as described above, a binder resin which has a low molecular weight and is also of a linear type molecular structure is easily manufactured.

When the toner of the present invention is produced by a polymerization method, a crosslinking agent may be added. The amount of the agent to be added is preferably 0.001 part by mass or more and 15 parts by mass or less with respect to 100 parts by mass of the polymerizable monomer.

Here, as the crosslinking agent, a compound having two or more polymerizable double bonds is mainly used. Examples thereof include: aromatic divinyl compounds such as divinylbenzene and divinylnaphthalene; carboxylates each having two double bonds, such as ethylene glycol diacrylate, ethylene glycol dimethacrylate, and 1,3-butanediol dimethacrylate; divinyl compounds such as divinylaniline, divinyl ether, divinyl sulfide, and divinyl sulfone; and a compound having three or more vinyl groups. Those can be used alone or in admixture of two or more kinds thereof.

In the method of producing the toner of the present invention by a polymerization method, in general, the above-mentioned toner composition and the like are appropriately added and uniformly dissolved or dispersed by means of a dispersion machine such as a homogenizer, a ball mill, or an ultrasonic dispersing device to prepare a polymerizable monomer composition, and this is suspended into an aqueous medium containing a dispersion stabilizer. In this case, it is recommended that a high-speed dispersing device such as a high-speed agitator or the ultrasonic dispersing device be used to provide a desired toner particle size at a stroke because the size distribution of the resultant toner particles becomes sharp. A polymerization initiator may be added simultaneously with the addition of other additives to the polymerizable monomer, or may be mixed immediately before suspension into the aqueous medium. In addition, immediately after granulation, a polymerization initiator dissolved into the polymerizable monomer or the solvent can be added before the initiation of a polymerization reaction.

After granulation, stirring is only required to be performed by an ordinary agitator to the extent that a particle state is maintained and the floating and sedimentation of a particle are prevented.

When the toner of the present invention is produced, a known surfactant, or a known organic dispersant or inorganic dispersant can be used as a dispersion stabilizer. Of those, an inorganic dispersant can be preferably used because the stability of the inorganic dispersant hardly collapses even when the reaction temperature is changed because the dispersant has a dispersion stability owing to its steric hindrance property. In addition, the inorganic dispersant can be easily washed, and has little adverse effect on the toner. Examples of such inorganic dispersant include: polyvalent metal phosphates such as tricalcium phosphate, magnesium phosphate, aluminum phosphate, zinc phosphate, and hydroxyapatite; carbonates such as calcium carbonate and magnesium carbonate; inorganic salts such as calcium metasilicate, calcium sulfate, and barium sulfate; and inorganic compounds such as calcium hydroxide, magnesium hydroxide, and aluminum hydroxide.

Such inorganic dispersant is preferably used in an amount of 0.2 part by mass or more and 20 parts by mass or less with respect to 100 parts by mass of the polymerizable monomer. In addition, one kind of the above-mentioned dispersion stabilizers may be used alone, or multiple kinds thereof may be used in combination. Further, a surfactant may be used in combination in an amount of 0.001 part by mass or more and 0.1 part by mass or less.

When each of the inorganic dispersants is used, the inorganic dispersant may be used as it is. Alternatively, particles of the inorganic dispersants can be produced in the aqueous medium for obtaining fine particles. For example, in the case of using tricalcium phosphate, an aqueous solution of sodium phosphate and an aqueous solution of calcium chloride are mixed under high-speed stirring, and thus water-insoluble calcium phosphate can be produced. As a result, dispersion can be performed with improved uniformity and improved fineness. At this time, a water-soluble sodium chloride salt is simultaneously produced as a by-product. The presence of a water-soluble salt in the aqueous medium is more convenient because the water-soluble salt suppresses the dissolution of the polymerizable monomer into water so that ultra-fine toner due to emulsion polymerization is hardly produced.

Examples of the surfactant include sodium dodecylbenzene sulfate, sodium tetradecyl sulfate, sodium pentadecyl sulfate, sodium octyl sulfate, sodium oleate, sodium laurate, sodium stearate, and potassium stearate.

In the step of polymerizing the above-mentioned polymerizable monomer, the polymerization temperature is set to 40° C. or more, generally 50° C. or more and 90° C. or less. When the polymerization is performed at a temperature within the range, a low melting point substance to be enclosed inside deposits owing to phase separation, thereby contributing to complete inclusion.

After that, there is a cooling step of cooling the resultant from a reaction temperature of 50° C. or more and 90° C. or less to terminate the polymerization reaction step. At that time, it is preferred that the cooling be gradually performed so that a state in which the release agent (a) and the binder resin are compatibilized with each other be maintained.

After the termination of the polymerization of the above-mentioned polymerizable monomer, the resultant polymer particles are filtrated, washed, and dried by known methods. Thus, toner particles are obtained. The toner particles are mixed with such an inorganic fine powder as described later as required so that the inorganic fine powder be caused to adhere to the surface of each of the toner particles. Thus, the toner of the present invention can be obtained. In addition, a coarse powder and a fine powder in the toner particles can be cut by incorporating a classifying step in the production steps (before the mixing of the inorganic fine powder).

The toner in the present invention may have an inorganic fine powder as well as the toner particles. The inorganic fine powder has a number-average primary particle diameter of preferably 4 nm or more and 80 nm or less, more preferably 6 nm or more and 40 nm or less. The inorganic fine powder is added for improving the flowability of the toner and uniformizing the charging of the toner particles. Further, functions such as the adjustment of the charge quantity of the toner and an improvement in its environmental stability can be imparted by subjecting the inorganic fine powder to a hydrophobic treatment.

In the present invention, a known measurement method can be employed as a method of measuring the number-average primary particle diameter of the inorganic fine powder. Specifically, the measurement can be performed with a photograph of the toner photographed with a scanning electron microscope at a certain magnification.

Silica, titanium oxide, alumina, or the like can be used as the inorganic fine powder to be used in the present invention. For example, both dry silica, which is so called dry process silica or fumed silica, produced by the vapor phase oxidation of a silicon halide and the so-called wet silica produced from water glass and the like can each be used as a silica fine powder. However, the dry silica is preferred because the number of silanol groups present on its surface and in the silica fine powder is small, and the amount of a production residue such as $Na_2O$ or $SO_3^{2-}$ is small. A composite fine powder of the silica and any other metal oxide can also be obtained by using any other metal halide such as aluminum chloride or titanium chloride together with the silicon halide in the production step, and such composite fine powder is also included in the category of the dry silica.

The addition amount of the inorganic fine powder having a number-average primary particle diameter of 4 nm or more and 80 nm or less is preferably 0.1 part by mass or more and 3.0 parts by mass or less with respect to 100 parts by mass of the toner particles. The content of the inorganic fine powder can be determined with a calibration curve created from a standard sample by employing fluorescent X-ray analysis.

In the present invention, the inorganic fine powder is preferably subjected to a hydrophobic treatment because the environmental stability of the toner can be improved. One kind of treatment agents such as a silicone varnish, various modified silicone varnishes, a silicone oil, various modified silicone oils, a silane compound, a silane coupling agent, and other organosilicon compounds and organic titanium compounds may be used alone as a treatment agent to be used in the hydrophobic treatment of the inorganic fine powder, or two or more kinds thereof may be used in combination.

The inorganic fine powder is preferably treated with the silicone oil out of the above-mentioned treatment agents, and is more preferably treated with the silicone oil simultaneously with the hydrophobic treatment of the inorganic fine powder with the silane compound or after the treatment. Such treatment method for the inorganic fine powder is, for example, as described below. A silylation reaction is performed with the silane compound as a first-stage reaction so that a silanol group be caused to disappear by a chemical bond. After that, the formation of a hydrophobic thin film on the surface of the inorganic fine powder with the silicone oil can be performed as a second-stage reaction.

The above-mentioned silicone oil has a viscosity at 25° C. of preferably 10 $mm^2/s$ or more and 200,000 $mm^2/s$ or less, more preferably 3,000 $mm^2/s$ or more and 80,000 $mm^2/s$ or less.

Particularly preferred examples of the silicone oil to be used include dimethyl silicone oil, methylphenyl silicone oil, α-methylstyrene-modified silicone oil, chlorophenyl silicone oil, and fluorine-modified silicone oil.

As a method of treating the inorganic fine powder with the silicone oil, there is given, for example, a method involving directly mixing the inorganic fine powder being treated with a silane compound and the silicone oil by means of a mixer such as a Henschel mixer, or a method involving spraying the silicone oil on the inorganic fine powder. Alternatively, a method involving dissolving or dispersing the silicone oil in a suitable solvent, then adding the inorganic fine powder, mixing the whole, and removing the solvent may be used. In view of the advantage that the inorganic fine powder agglomerates in a relatively small amount, a method involving spraying the silicone oil is more preferred.

The treatment amount of the silicone oil is preferably 1 part by mass or more and 40 parts by mass or less, more preferably 3 parts by mass or more and 35 parts by mass or less with respect to 100 parts by mass of the inorganic fine powder.

The inorganic fine powder to be used in the present invention has a specific surface area measured by a BET method based on nitrogen adsorption of preferably 20 $m^2/g$ or more and 350 $m^2/g$ or less, more preferably 25 $m^2/g$ or more and 300 $m^2/g$ or less for imparting good flowability to the toner. The specific surface area is calculated by employing a BET multipoint method with a specific surface area-measuring apparatus AUTOSORB 1 (manufactured by Yuasa Ionics Inc.) while causing a nitrogen gas to adsorb to the sample surface according to the BET method.

Further, in the toner of the present invention, a small amount of any other additive may also be used, for example, a lubricant powder such as a fluororesin powder, a zinc stearate powder, or a polyvinylidene fluoride powder; an abrasive such as a cerium oxide powder, a silicon carbide powder, or a strontium titanate powder; a flowability-imparting agent such as a titanium oxide powder or an aluminum oxide powder; a caking inhibitor; or organic and/or inorganic fine particles opposite in polarity as a developing performance-improving agent. The surface of any such additive can be subjected to a hydrophobic treatment before the additive is used.

An example of an image-forming apparatus in which the toner of the present invention can be suitably used is specifically described with reference to drawings.

In an image-forming apparatus of FIG. 1, the periphery of a photosensitive member 100 is provided with a primary charging roller 117, a developing unit 140, a transfer charging roller 114, a cleaner 116, a register roller 124, and the like. In addition, the photosensitive member 100 is charged to, for example, −700 V by the primary charging roller 117 (applied voltages are an AC voltage of −2.0 kVpp and a DC voltage of −700 Vdc). In addition, laser light 123 is applied from a laser-generating apparatus 121 to the photosensitive member 100 so that the photosensitive member be exposed. An electrostatic latent image on the photosensitive member 100 is developed with a one-component magnetic developer by the developing unit 140, and is then transferred onto a transfer material by the transfer charging roller 114 brought into abutment with the photosensitive member through the transfer material. The transfer material carrying the toner image is conveyed to a fixing unit 126 by a conveying belt 125 so that the toner image be fixed on the transfer material. In addition, the toner remaining in part on the photosensitive member is cleaned by the cleaner 116.

Figure 2:
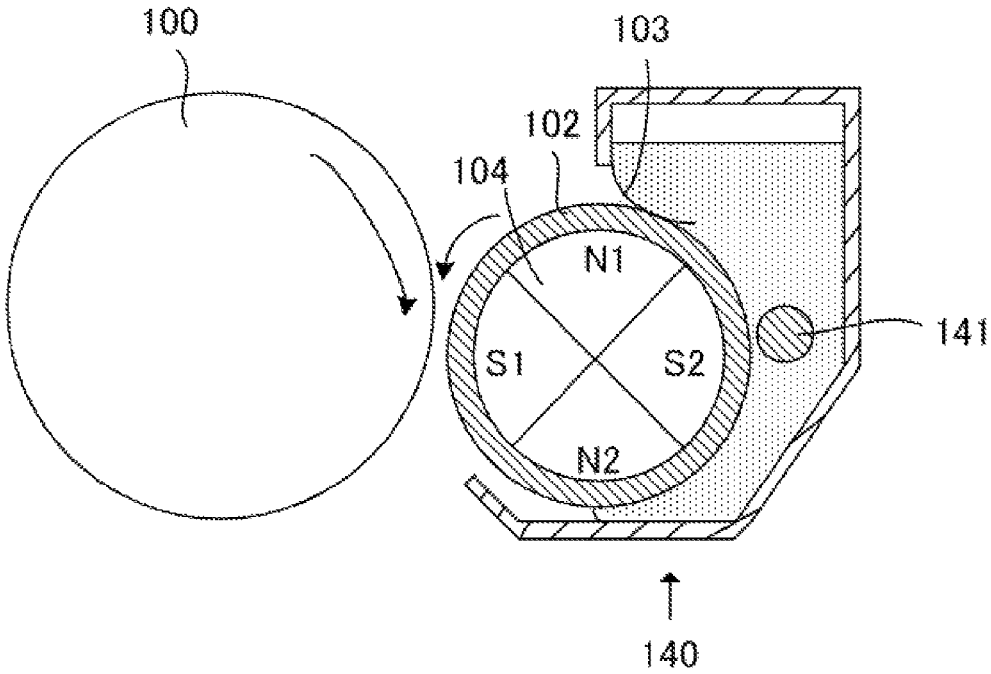
FIG. 2 is an explanatory diagram of a developing unit.

As illustrated in FIG. 2, the developing unit 140 is provided with a cylindrical toner carrier 102 (which may hereinafter be referred to as "developing sleeve") made of a non-magnetic metal such as aluminum or stainless steel, the developing sleeve being brought close to the photosensitive member 100, and the gap between the photosensitive member 100 and the developing sleeve 102 is maintained at about 300 μm by, for example, a developing sleeve/photosensitive member gap-holding member (not shown). A magnet roller 104 is fixed and provided in the developing sleeve 102 so as to be concentric with the developing sleeve, provided that the developing sleeve 102 is rotatable.

As illustrated in the figure, the magnet roller 104 is provided with multiple magnetic poles, and the magnetic poles S1, N1, S2, and N2 affect the development, the regulation of a toner coat amount, the take-up and conveyance of the toner, and the prevention of the blowout of the toner, respectively. The toner is applied to the developing sleeve 102 by a toner-applying roller 141, and is then conveyed while adhering to the developing sleeve. A developing blade 103 as a member for regulating the amount of the toner to be conveyed is provided, and the amount of the toner to be conveyed to a developing region is controlled by the abutment pressure of the developing blade 103 against the developing sleeve 102. In the developing region, DC and AC developing biases are applied between the photosensitive member 100 and the developing sleeve 102, and the developer on the developing sleeve flies onto the photosensitive member 100 depending on the electrostatic latent image to turn the image into a visible image.

Next, methods of measuring various physical properties according to the present invention are described.

<Average Particle Diameter and Particle Diameter Distribution of Toner>

The weight-average particle diameter (D4) of the toner is calculated in the following manner. As a measuring apparatus, a precision grain size distribution measuring apparatus based on a pore electrical resistance method provided with a 100-μm aperture tube "Coulter Counter Multisizer 3" (registered trademark, manufactured by Beckman Coulter, Inc.) is used. For setting measurement conditions and analyzing measurement data, the dedicated software attached to the apparatus "Beckman Coulter Multisizer 3 Version 3.51" (manufactured by Beckman Coulter, Inc) is used. It should be noted that the measurement is performed with the number of effective measurement channels set to 25,000.

An electrolyte solution prepared by dissolving reagent grade sodium chloride in ion-exchanged water to have a concentration of about 1 mass %, for example, an "ISOTON II" (manufactured by Beckman Coulter, Inc) can be used in the measurement.

It should be noted that setting for the dedicated software was made as described below prior to the measurement and the analysis.

In the "change standard measurement method (SOM)" screen of the dedicated software, the total count number of a control mode is set to 50,000 particles, the number of times of measurement is set to 1, and a value obtained by using "standard particle having a particle diameter of 10.0 μm" (manufactured by Beckman Coulter, Inc) is set as a Kd value. A threshold and a noise level are automatically set by pressing a "threshold/noise level measurement button." In addition, the current is set to 1,600 μA, the gain is set to 2, the electrolyte solution is set to an ISOTON II, and a check mark is placed in a check box as to whether "the aperture tube is flushed after the measurement."

In the "setting for conversion from pulse to particle diameter" screen of the dedicated software, the bin interval is set to a logarithmic particle diameter, the number of particle diameter bins is set to 256, and the particle diameter range is set to the range of 2 μm to 60 μm.

A specific measurement method is as described below.

(1) About 200 ml of the electrolyte solution are put into a 250-ml round-bottom beaker made of glass dedicated for the Multisizer 3. The beaker is set in a sample stand, and the electrolyte solution in the beaker is stirred with a stirrer rod at 24 rotations/sec in a counterclockwise direction. Then, dirt and bubbles in the aperture tube are removed by the "aperture flush" function of the dedicated software.

(2) About 30 ml of the electrolyte solution are put into a 100-ml flat-bottom beaker made of glass. About 0.3 ml of a diluted solution prepared by diluting a "Contaminon N" (a 10-mass % aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by about three mass fold is added as a dispersant to the electrolyte solution.

(3) An ultrasonic dispersing unit "Ultrasonic Dispersion System Tetra 150" (manufactured by Nikkaki Bios Co., Ltd.) in which two oscillators each having an oscillatory frequency of 50 kHz are provided so as to be mutually out of phase by 180° and which has an electrical output of 120 W is prepared. About 3.3 l of ion-exchanged water is put into the water tank of the ultrasonic dispersing unit. About 2 ml of the Contaminon N are put into the water tank.

(4) The beaker in the item (2) is set in the beaker fixing hole of the ultrasonic dispersing unit, and the ultrasonic dispersing unit is operated. Then, the height position of the beaker is adjusted in order that the resonation of the liquid level of the electrolyte solution in the beaker be maximum.

(5) About 10 mg of the toner is gradually added to and dispersed in the electrolyte solution in the beaker in the item (4) in a state in which the electrolyte solution is irradiated with the ultrasonic wave. Then, the ultrasonic dispersion treatment is continued for additional 60 seconds. It should be noted that the temperature of water in the water tank is appropriately adjusted so as to be 10° C. or more and 40° C. or less upon ultrasonic dispersion.

(6) The electrolyte solution in the item (5) in which the toner has been dispersed is dropped with a pipette to the round-bottom beaker in the item (1) placed in the sample stand, and the concentration of the toner to be measured is adjusted to about 5%. Then, measurement is performed until the particle diameters of 50,000 particles are measured.

(7) The measurement data is analyzed with the dedicated software attached to the apparatus, and the weight-average particle diameter (D4) is calculated. It should be noted that "average diameter" on the "analysis/volume statistics (arithmetic average)" screen of the dedicated software when the dedicated software is set to graph/volume % is the weight-average particle diameter (D4).

<Measurement of Average Circularity of Toner>

The average circularity of toner is measured at the time of correction operation and under analysis conditions with a flow-type particle image analyzer "FPIA-3000" (manufactured by SYSMEX CORPORATION).

A specific measurement method is as described below. First, about 20 ml of ion-exchanged water from which impure solid and the like have been removed in advance are put into a container made of glass. About 0.2 ml of a diluted solution prepared by diluting "Contaminon N" (a 10-mass % aqueous solution of a neutral detergent for washing a precision measuring unit formed of a nonionic surfactant, an anionic surfactant, and an organic builder and having a pH of 7, manufactured by Wako Pure Chemical Industries, Ltd.) with ion-exchanged water by about three mass fold is added as a dispersant to the container. Further, about 0.02 g of a measurement sample is added to the container, and then the mixture is subjected to a dispersion treatment with an ultrasonic dispersing unit for 2 minutes so that a dispersion liquid for measurement be obtained. At that time, the dispersion liquid is appropriately cooled so as to have a temperature of 10° C. or more and 40° C. or less. A desktop ultrasonic cleaning and dispersing unit having an oscillatory frequency of 50 kHz and an electrical output of 150 W (such as a "VS-150" (manufactured by VELVO-CLEAR)) is used as the ultrasonic dispersing unit. A predetermined amount of ion-exchanged water is put into a water tank, and about 2 ml of the Contaminon N are added to the water tank.

The flow-type particle image analyzer mounted with an "UPlanApro" (magnification: 10, numerical aperture: 0.40) as an objective lens was used in the measurement, and a particle sheath "PSE-900A" (manufactured by SYSMEX CORPORATION) was used as a sheath liquid. The dispersion liquid prepared in accordance with the procedure is introduced into the flow-type particle image analyzer, and 3,000 toner particles are subjected to measurement according to the total count mode of an HPF measurement mode. Then, the average circularity of the toner particles is determined with a binarization threshold at the time of particle analysis set to 85% and with particle diameters to be analyzed limited to those corresponding to a circle-equivalent diameter of 1.985 μm or more and less than 39.69 μm.

On the measurement, automatic focusing is performed with standard latex particles (obtained by diluting, for example, "RESEARCH AND TEST PARTICLES Latex Microsphere Suspensions 5200A" manufactured by Duke Scientific with ion-exchanged water) prior to the initiation of the measurement. After that, focusing is preferably performed every two hours from the initiation of the measurement.

It should be noted that in each example of the present application, a flow-type particle image analyzer which had been subjected to a calibration operation by SYSMEX CORPORATION and received a calibration certificate issued by SYSMEX CORPORATION was used. The measurement was performed under measurement and analysis conditions identical to those at the time of the reception of the calibration certificate except that particle diameters to be analyzed were limited to those corresponding to a circle-equivalent diameter of 1.985 μm or more and less than 39.69 μm.

<SEC-MALLS Measurement of Toner at 25° C. (Mw, Rw, Mn (25° C.))>

The weight-average molecular weight Mw, radius of gyration Rw, and number-average molecular weight Mn (25° C.) of the tetrahydrofuran-soluble components of the toner of the present invention at 25° C. were determined by size exclusion chromatography-multiangle laser light scattering (SEC-MALLS) measurement.

0.03 g of the toner is dispersed in 10 ml of tetrahydrofuran. The resultant dispersion liquid is shaken with a shaker at 25° C. for 24 hours, and is then filtrated through a 0.2-μm filter. The resultant filtrate is used as a sample.

Analysis Conditions:

Separating column: Shodex (TSK GMHHR-H HT20)×2

Column temperature: 25° C.

Mobile phase solvent: tetrahydrofuran

Mobile phase flow rate: 1.0 ml/min.

Sample concentration: about 0.3%

Injection amount: 300 μl

Detector 1: Multiangle laser light scattering detector Wyatt DAWN EOS

Detector 2: Differential refractive index detector Shodex RI-71

It should be noted that data analysis was performed with an ASTRA for Windows 4.73.04 (Wyatt Technology Corp.).

<SEC-MALLS Measurement of Toner at 135° C. (Mn (135° C.))>

The number-average molecular weight Mn (135° C.) of the o-dichlorobenzene-soluble components of the toner of the present invention at 135° C. were determined by SEC-MALLS measurement.

0.03 g of the toner is dispersed in 10 ml of o-dichlorobenzene. The resultant dispersion liquid is shaken with a shaker at 135° C. for 24 hours, and is then filtrated through a 0.2-μm filter. The resultant filtrate is used as a sample.

Analysis Conditions:

Separating column: Shodex (TSK GMHHR-H HT20)×2

Column temperature: 135° C.

Mobile phase solvent: o-dichlorobenzene

Mobile phase flow rate: 1.0 ml/min.

Sample concentration: about 0.3%

Injection amount: 300 μl

Detector 1: Multiangle laser light scattering detector Wyatt DAWN EOS

Detector 2: Differential refractive index detector Shodex RI-71

It should be noted that data analysis was performed with an ASTRA for Windows 4.73.04 (Wyatt Technology Corp.).

<Measurement of Proportion of Components Having Molecular Weight of 500 or Less in Tetrahydrofuran-Soluble Components of Toner, and Weight-Average Molecular Weight Mw and Number-Average Molecular Weight Mn of Polyester Resin>

A proportion of components having a molecular weight of 500 or less in the tetrahydrofuran-soluble components of the toner, and the weight- and number-average molecular weights of the polyester resin are measured by gel permeation chromatography (GPC) as described below.

First, the toner or the polyester resin is dissolved in tetrahydrofuran (which may hereinafter be referred to as "THF") at room temperature over 24 hours. Then, the resultant solution is filtrated through a solvent-resistant membrane filter "Maeshori Disk" (manufactured by TOSOH CORPORATION) having a pore diameter of 0.2 μm so that a sample solution be obtained. It should be noted that the sample solution is prepared so that the concentration of components soluble in THF be about 0.8 mass %. The measurement is performed with the sample solution under the following conditions.

Apparatus: HLC 8120 GPC (detector: RI) (manufactured by TOSOH CORPORATION)

Column: Septuplicate of Shodex KF-801, 802, 803, 804, 805, 806, and 807 (manufactured by Showa Denko K. K.)

Eluent: tetrahydrofuran

Flow rate: 1.0 ml/min

Oven temperature: 40.0° C.

Sample injection amount: 0.10 ml

The proportion of components having a molecular weight of 500 or less in the tetrahydrofuran-soluble components of the toner is the proportion of the area in a chart obtained by this GPC measurement (abscissa: retention time, ordinate: voltage detected by RI). In the calculation of the molecular weight of the sample, a molecular weight calibration curve prepared with standard polystyrene resins (for example, product names "TSK standard polystyrenes F-850, F-450, F-288, F-128, F-80, F-40, F-20, F-10, F-4, F-2, F-1, A-5000, A-2500, A-1000, and A-500" manufactured by Tosoh Corporation) is used. The weight-average molecular weight Mw and number-average molecular weight Mn of the polyester resin were calculated from the molecular weight distribution obtained by applying the molecular weight calibration curve to the chart obtained by the GPC measurement.

<Measurement of Peak Top Temperature of Maximum Endothermic Peak of Release Agent>

The peak top temperature (melting point) of the maximum endothermic peak of a release agent is measured with a differential scanning calorimeter "Q1000" (manufactured by TA Instruments) in conformity with ASTM D3418-82.

The melting points of indium and zinc are used for the temperature correction of the detecting portion of the apparatus, and the heat of fusion of indium is used for the correction of heat quantity.

Specifically, about 10 mg of the release agent are precisely weighed. The release agent is put into an aluminum pan, and then the measurement is performed with an empty aluminum pan as a reference in the measuring temperature range of 30° C. to 200° C. at a heating rate of 10° C./min. It should be noted that in the measurement, the temperature is increased to 200° C. once, subsequently decreased to 30° C., and then increased again. The maximum endothermic peak of a DSC curve in the temperature range of 30° C. to 200° C. in the second temperature increase process is defined as the endothermic peak top of the endothermic curve in the DSC of the release agent.

<Method of Measuring Acid Value of Release Agent>

The acid value of the release agent is measured in conformity with JIS K 1557-1970. A specific measurement method is as described below.

First, 2 g of the release agent are precisely weighed (W (g)). The sample is put into a 200-ml three-necked flask, and 100 ml of a mixed solution of toluene and ethanol (2:1) are added to dissolve the sample over 5 hours. Then, a phenolphthalein solution is added as an indicator. Using a 0.1 N KOH/alcohol solution, the above-mentioned solution is titrated by means of a buret. The amount of the KOH solution at this time is represented by S (ml). Blank test is performed, and the amount of the KOH solution at this time is represented by B (ml)

The acid value is calculated from the following equation.

$$\text{Acid value}=[(S-B)\times f\times 5.61]/W$$

(f: factor of KOH solution)

<Solubility of Release Agent in Binder Resin>

The solubility of a release agent in the binder resin is measured as described below.

Styrene-acrylic resin (resin obtained by polymerizing 74 parts by mass of styrene and 26 parts by mass of butyl acrylate, glass transition temperature
(Tg)=54.0° C., number-average molecular weight
(Mn)=20,000, weight-average molecular weight
(Mw)=200,000): 0.10 g
Release agent: 0.01 g The above-mentioned materials are mixed in an agate mortar so that a sample 1 be obtained.

A differential scanning calorimeter "Q1000" (manufactured by TA Instruments) or "DSC2920" (manufactured by TA Instruments) can be used as a measuring apparatus, and the measurement is performed in conformity with ASTM D3418-82.

About 10 mg of the sample 1 is precisely weighed and put into an aluminum pan, and then the endotherm of the sample is measured with, for example, "Q1000" and with an empty aluminum pan as a reference according to the following sequence. The melting points of indium and zinc are used for the temperature correction of the detecting portion of the apparatus, and the heat of fusion of indium is used for the correction of the heat quantity.

Then, the solubility is determined from the following equation where ΔH1 represents the endothermic peak heat quantity of a second cycle and ΔH2 represents the endothermic peak heat quantity of a fourth cycle. It should be noted that each endothermic peak heat quantity is the heat quantity of the maximum endothermic peak in a DSC curve in the temperature range of 30 to 120° C. during heating.

$$\text{Solubility}=(1-\Delta H2/\Delta H1)\times 100$$

<Sequence>

First Cycle:

Keep the temperature at 30° C. for 1 minute.

Increase the temperature to 60° C. at a rate of 2° C./min.

Keep the temperature for 10 minutes after temperature increase.

Decrease the temperature to 30° C. at a rate of 10° C./min.

Second Cycle:

Keep the temperature at 30° C. for 1 minute.

Increase the temperature to 120° C. at a rate of 10° C./min.

Keep the temperature for 10 minutes after temperature increase.

Decrease the temperature to 30° C. at a rate of 10° C./min.

Third Cycle:

Keep the temperature at 30° C. for 1 minute.

Increase the temperature to 60° C. at a rate of 2° C./min.

Keep the temperature for 10 minutes after temperature increase.

Decrease the temperature to 30° C. at a rate of 10° C./min.

Fourth Cycle:

Keep the temperature at 30° C. for 1 minute.

Increase the temperature to 120° C. at a rate of 10° C./min.

Keep the temperature for 10 minutes after temperature increase.

Decrease the temperature to 30° C. at a rate of 10° C./min.

Although the above-mentioned styrene-acrylic resin is preferably used, when its preparation is difficult, the measurement may be performed with a styrene-acrylic resin having a glass transition temperature of 54.0° C.±1.0° C., a number-average molecular weight (Mn) of 20,000±2,000, and a weight-average molecular weight (Mw) of 200,000±20,000. As long as the parameters fall within the above-mentioned ranges, substantially the same value for the solubility is obtained.

In addition, a binder resin having a low molecular weight or a binder resin with its branched structure adjusted has been used as the binder resin in the present invention. It has been confirmed that in this case, the absolute values of the solubilities change but which one of the release agents has a larger solubility in the binder resin than that of the other does not change. Accordingly, in the present invention, the above-mentioned measured values were used as the solubilities of the release agent (a) and the release agent (b) in the binder resin.

<Total Energy of Toner Particles>

The total energy of the toner particles in the present invention when a propeller type blade is caused to penetrate a toner particle layer at an agitation rate of 100 mm/sec is measured with a powder flowability analyzer Powder Rheometer FT-4 (manufactured by Freeman Technology) (which may hereinafter be referred to as "FT-4").

Figure 3A:
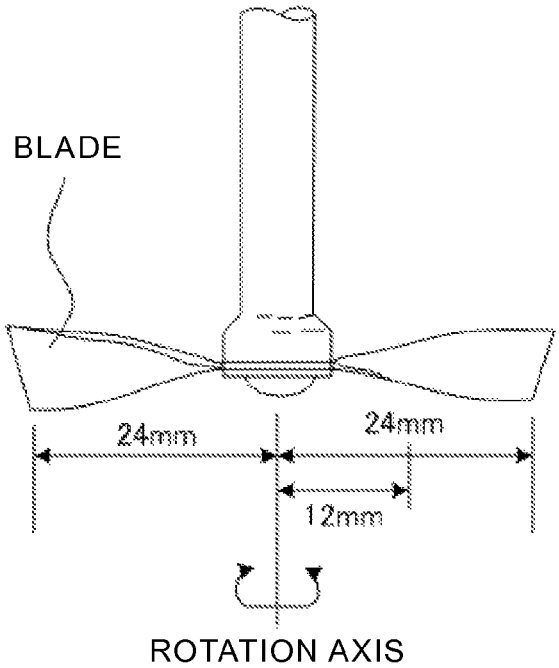
FIGS. 3A and 3B are each an explanatory diagram of a blade portion of an apparatus to be used in the measurement of the total energy of toner particles.
Figure 3B:
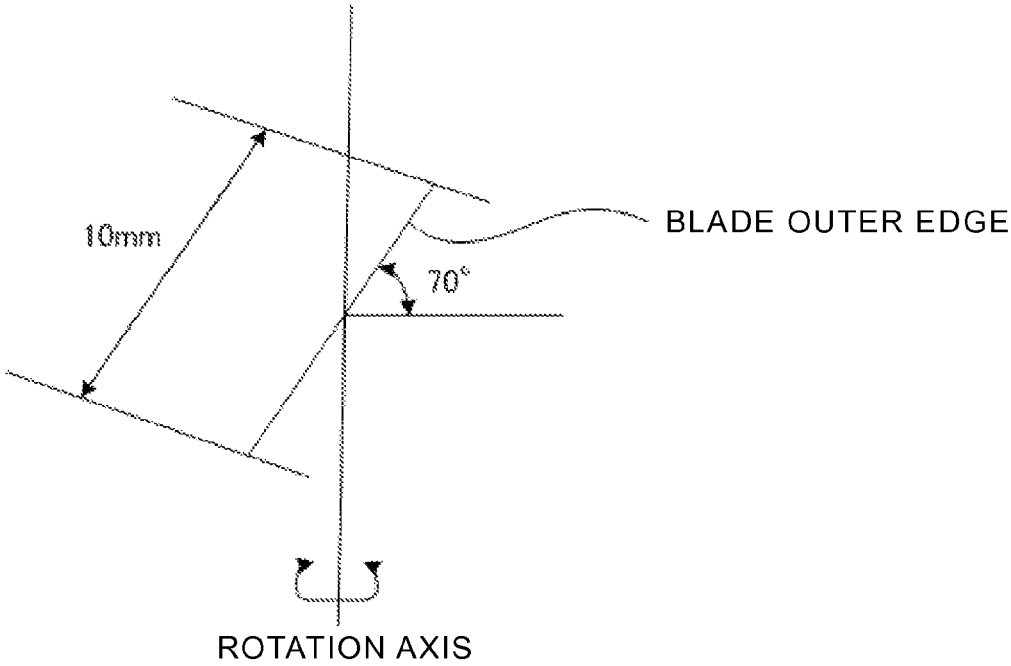

Specifically, the measurement is performed by the following operations. It should be noted that a blade dedicated for measurement with the FT-4 having a diameter of 48 mm (which may hereinafter be abbreviated as "blade." See, FIGS. 3A and 3B: the blade has its rotation axis at the center of its blade plate measuring 48 mm by 10 mm in the direction normal to the center, material: SUS, model: C210, twisted smoothly in a counterclockwise direction such that both outermost edge portions (portions each placed at a distance of 24 mm from the rotation axis) each form an angle of 70°, and portions each placed at a distance of 12 mm from the rotation axis each form an angle of 35°) is used as a propeller type blade in each of all the operations.

100 g of magnetic toner particles left to stand under an environment having a temperature of 23° C. and a humidity of 60% for 3 days or longer are put into a cylindrical split cell dedicated for measurement with the FT-4 having a diameter of 50 mm and a volume of 160 ml (which may hereinafter be abbreviated as "cell." model: C203, height from the bottom surface of the container to a split portion: 82 mm, material: glass) so that a powder layer (toner particle layer) is formed.

(1) Conditioning Operation (a) The blade is caused to penetrate from the surface of the powder layer to a position at a distance of 10 mm from the bottom surface of the powder layer under the following conditions: the rotational speed of the blade in a clockwise direction relative to the surface of the powder layer (direction in which the powder layer is loosened by the rotation of the blade) is set so that the circumferential speed of each outermost edge portion be 60 (mm/sec); and the speed at which the blade is caused to penetrate into the powder layer in the direction perpendicular to the layer is set so that the angle formed between a path taken by each outermost edge portion of the blade during the movement and the surface of the powder layer be 5 (deg) (which may hereinafter be abbreviated as "angle formed"). After that, the operation of causing the blade to penetrate into a position at a distance of 1 mm from the bottom surface of the magnetic powder layer is performed under the following conditions: the rotational speed of the blade in the clockwise direction relative to the surface of the powder layer is 60 (mm/sec); and the speed at which the blade is caused to penetrate into the powder layer in the direction perpendicular to the layer is such that the angle formed is 2 (deg). After that, the blade is moved to a position at a distance of 100 mm from the bottom surface of the powder layer under the following conditions so as to be pulled out the rotational speed of the blade in the clockwise direction relative to the surface of the powder layer is 60 (mm/sec); and the speed at which the blade is pulled out from the powder layer is such that the angle formed is 5 (deg). After the completion of the pulling out, the blade is rotated in the clockwise and counterclockwise directions alternately to a small extent so that the toner adhering to the blade is shaken off.

(b) The series of operations in the above-mentioned item (1)-(a) is performed five times so that air involved in the toner powder layer is removed. Thus, a stable magnetic toner powder layer is produced.

(2) Split Operation

The powder layer is leveled off with the split portion of the above-mentioned cell dedicated for measurement with the FT-4, and the toner in the upper portion of the powder layer is removed, thereby forming powder layers having the same volume.

(3) Measurement Operation (a) A conditioning operation similar to that of the above-mentioned item (1)-(a) is performed once. Next, the blade is caused to penetrate into a position at a distance of 10 mm from the bottom surface of a powder layer under the following conditions: the rotational speed of the blade in a counterclockwise direction relative to the surface of the powder layer (direction in which the powder layer is squeezed by the rotation of the blade) is set to 100 (mm/sec); and the speed at which the blade is caused to penetrate into the powder layer in the direction perpendicular to the layer is such that the angle formed is 5 (deg). After that, the operation of causing the blade to penetrate into a position at a distance of 1 mm from the bottom surface of the powder layer is performed under the following conditions: the rotational speed of the blade in the clockwise direction relative to the surface of the powder layer is set to 60 (mm/sec); and the speed at which the blade is caused to penetrate into the powder layer in the direction perpendicular to the layer is such that the angle formed is 2 (deg). After that, the blade is pulled out to a position at a distance of 100 mm from the bottom surface of the powder layer under the following conditions: the rotational speed of the blade in the clockwise direction relative to the surface of the powder layer is set to 60 (mm/sec); and the speed at which the blade is pulled out from the powder layer in the direction perpendicular to the layer is such that the angle formed is 5 (deg). After the completion of the pulling out, the blade is rotated in the clockwise and counterclockwise directions alternately to a small extent so that the toner adhering to the blade is shaken off.

(b) The above-mentioned series of operations is repeated seven times. At the seventh repetition, measurement is initiated from the position at a distance of 100 mm from the bottom surface of the toner powder layer at a rotational speed of the blade of 100 (mm/sec). A sum total of a rotation torque and a vertical load obtained at the time when the blade is caused to penetrate to the position at a distance of 10 mm from the bottom surface is defined as a total energy when an agitation rate is 100 mm/sec.

<Polymerization Conversion Degree>

A polymerization conversion degree in the suspension polymerization method was calculated by determining the amount of a residual styrene monomer. That is, the polymerization conversion degree when the whole amount of an added styrene monomer was detected in the following measurement was set to 0%, and the polymerization conversion degree when the styrene monomer was no longer detected in the toner as a polymerization reaction progressed was set to 100%.

The amount of the styrene monomer remaining in the toner is measured by gas chromatography (GC) as described below.

About 500 mg of the toner is precisely weighed and put into a sample bottle. About 10 g of acetone that have been precisely weighed is added to the toner, and then the sample bottle is capped. After that, the contents are mixed well, and then the mixture is irradiated with an ultrasonic wave from a desktop ultrasonic cleaning unit having an oscillatory frequency of 42 kHz and an electrical output of 125 W (such as a product available under the trade name "B2510J-MTH" from Branson Co.) for 30 minutes. After that, the resultant is filtrated through a solvent-resistant membrane filter "Maishori Disk" (manufactured by TOSOH CORPORATION) having a pore diameter of 0.2 μm, and then 2 μl of the filtrate are analyzed by gas chromatography. Then, the remaining amount of the residual styrene monomer is calculated from a calibration curve created in advance with styrene. Measuring apparatuses and measurement conditions are as follows.

GC: 6890 GC, manufactured by Hewlett-Packard Development Company

Column: INNOWax manufactured by Hewlett-Packard Development Company (200 μm×0.40 μm×25 m)

Carrier Gas: He (Constant pressure mode: 20 psi)

Oven: (1) Hold for 10 minutes at 50° C.

(2) Increase the temperature to 200° C. at a rate of 10° C./min (3) Hold for 5 minutes at 200° C.

Injection port: 200° C., pulsed splitless mode (20 to 40 psi, until: 0.5 minutes)

Split ratio: 5.0:1.0

Detector: 250° C. (FID)

<Method of Measuring Content of Tetrahydrofuran-Insoluble Component>

About 1.5 g of the toner is weighed (W1 g) and placed in extraction thimble filter (such as a product available under the trade name "No. 86R" (size: 28×100 mm) from Advantec Toyo Co.) which has been weighed in advance. The resultant is set in a Soxhlet extractor, and is then subjected to extraction with 200 ml of tetrahydrofuran as a solvent for 10 hours. At this time, the extraction is performed at such a reflux rate that the cycle of the extraction with the solvent is once per about five minutes.

After the termination of the extraction, the extraction thimble is taken out and air-dried. After that, the extraction thimble filter is dried in a vacuum at 40° C. for 8 hours, and then the mass of the extraction thimble filter including the extraction residue is weighed. The mass (W2 g) of the extraction residue is calculated by subtracting the mass of the extraction thimble filter from the weighted mass.

Next, the content (W3 g) of the other components than the resin component is determined by the following procedure. About 2 g of the toner is weighed (Wa g) in a 30-ml magnetic crucible that has been weighed in advance. The crucible is placed in an electric furnace, heated at about 900° C. for about 3 hours, left standing to cool in the electric furnace, and left standing to cool under normal temperature in a desiccator for 1 hour or more. Then, the mass of the crucible containing the incineration residual ash is weighed, and the mass of the incineration residual ash (Wb g) is calculated by subtracting the mass of the crucible from the weighed mass. Then, the mass (W3 g) of the incineration residual ash in W1 g of the sample is calculated from the following equation.

$$W3=W1\times(Wb/Wa)$$

In this case, the content of the tetrahydrofuran-insoluble component is determined from the following equation.

Content of tetrahydrofuran-insoluble component $$(\text{mass }\%)=\{(W2-W3)/(W1-W3)\}\times 100$$

Hereinafter, the present invention is described in more detail by way of examples and comparative examples. It should be noted that the term "part(s)" refers to "part(s) by mass" unless otherwise stated.

<Monofunctional or Bifunctional Ester Wax>

Waxes shown in Table 1 below were each prepared as a monofunctional or bifunctional ester wax.

TABLE 1

| No. | Monofunctional or bifunctional ester wax | Peak top temperature of maximum endothermic peak (° C.) | Acid value | Solubility into binder resin |
|---|---|---|---|---|
| E1 | Myristyl myristate | 44 | 0.7 | 12.0 |
| E2 | Stearyl stearate | 61 | 0.9 | 4.3 |
| E3 | Behenyl behenate | 73 | 0.2 | 3.1 |
| E4 | Dibehenyl sebacate | 73 | 0.2 | 2.6 |
| E5 | Distearyl terephthalate | 85 | 0.6 | 0.4 |

<Hydrocarbon Wax>

Waxes shown in Table 2 below were each prepared as a hydrocarbon wax.

TABLE 2

| No. | Hydrocarbon wax | Peak top temperature of maximum endothermic peak (° C.) | Solubility into binder resin |
|---|---|---|---|
| P1 | Paraffin wax (HNP-12: manufactured by NIPPON SEIRO CO., LTD.) | 67 | 2.5 |
| P2 | Paraffin wax (HNP-9: manufactured by NIPPON SEIRO CO., LTD.) | 75 | 2.3 |

TABLE 2-continued

| No. | Hydrocarbon wax | Peak top temperature of maximum endothermic peak (° C.) | Solubility into binder resin |
|---|---|---|---|
| P3 | Fischer-Tropsch wax (HNP-51: manufactured by NIPPON SEIRO CO., LTD.) | 77 | 1.9 |

<Polymerization Initiator>

Polymerization initiators shown in Table 3 below were each prepared.

TABLE 3

| No. | Polymerization initiator | 10-Hour halflife temperature (° C.) |
|---|---|---|
| R1 | Di(sec-butyl) peroxydicarbonate | 51 |
| R2 | Diisononanoyl peroxide | 61 |
| R3 | 2,2'-Azobis(2,4-dimethylvaleronitrile) | 51 |

<Synthesis of Polyester Resin 1>

The following components were put into a reaction tank provided with a cooling tube, an agitator, and a nitrogen-introducing tube, and were then subjected to a reaction at 230° C. in a stream of nitrogen for 10 hours while produced water was removed by distillation.

| | |
|---|---|
| Adduct of bisphenol A with 2 mol of propylene oxide | 225 parts |
| Adduct of bisphenol A with 3 mol of propylene oxide | 450 parts |
| Terephthalic acid | 280 parts |
| Titanium-based catalyst (titanium dihydroxy-bis(triethanolaminate)) | 2 parts |

Next, the components were subjected to a reaction under a reduced pressure of 5 to 20 mmHg, and then the resultant was cooled to 180° C. when its acid value became 2 mgKOH/g or less. 62 Parts of trimellitic anhydride was added to the resultant, and then the mixture was subjected to a reaction under normal pressure in a hermetically sealed state for 2 hours. After that, the resultant was taken out and cooled to room temperature, followed by pulverization. Thus, a polyester resin was obtained. The resultant polyester resin 1 had a weight-average molecular weight Mw of 10,500, a number-average molecular weight Mn of 3,800, and an acid value of 6.

<Synthesis of Polyester Resin 2>

The following components were put into a reaction tank provided with a cooling tube, an agitator, and a nitrogen-introducing tube, and were then subjected to a reaction at 230° C. in a stream of nitrogen for 10 hours while produced water was removed by distillation.

| | |
|---|---|
| Adduct of bisphenol A with 2 mol of propylene oxide | 225 parts |
| Adduct of bisphenol A with 3 mol of propylene oxide | 450 parts |
| Terephthalic acid | 280 parts |
| Antimony-based catalyst (antimony trioxide) | 2 parts |

Next, the components were subjected to a reaction under a reduced pressure of 5 to 20 mmHg, and then the resultant was cooled to 180° C. when its acid value became 2 mgKOH/g or less. 62 Parts of trimellitic anhydride was added to the resultant, and then the mixture was subjected to a reaction under normal pressure in a hermetically sealed state for 2 hours.

After that, the resultant was taken out and cooled to room temperature, followed by pulverization. Thus, a polyester resin was obtained. The resultant polyester resin 2 had a weight-average molecular weight Mw of 10,300, a number-average molecular weight Mn of 4,000, and an acid value of 7.

<Synthesis of Styrene-Acrylic Copolymer 1>

| | |
|---|---|
| Styrene | 75.0 parts |
| n-Butyl acrylate | 25.0 parts |
| Polymerization initiator R1 | 0.5 part |

The above-mentioned raw materials were dropped to 200 parts of heated xylene over 4 hours. Further, polymerization was completed under xylene reflux. A styrene-acrylic resin 1 thus obtained had a weight-average molecular weight Mw measured by SEC-MALLS of 100,000, an Rw/Mw of $5.0\times10^{-4}$, and a glass transition temperature Tg of 60° C.

<Production Example of Magnetic Iron Oxide 1>

In an aqueous ferrous sulfate solution, a sodium hydroxide solution (containing 1 mass % of sodium hexametaphosphate in terms of P with respect to Fe) was mixed in an amount of 1.0 equivalent with respect to the iron ions, to prepare an aqueous solution containing ferrous hydroxide. Air was blown into the aqueous solution while the pH of the aqueous solution was kept at 9, and an oxidation reaction was performed at 80° C., thereby preparing a slurry liquid for producing a seed crystal.

Next, to this slurry liquid, an aqueous ferrous sulfate solution was added so as to be in an amount of 1.0 equivalent with respect to the initial alkali content (the sodium component in the sodium hydroxide). Then, the pH of the slurry liquid was kept at 8, and an oxidation reaction was advanced while air was blown into the liquid. The pH of the liquid was adjusted to about 6 at the terminal stage of the oxidation reaction. 1.5 parts of $n\text{-}C_6H_{13}Si(OCH_3)_3$ was added as a silane coupling agent with respect to 100 parts of a magnetic iron oxide, and then the mixture was sufficiently agitated. Hydrophobic iron oxide particles thus produced were washed, filtrated, and dried by ordinary methods. After agglomerating particles had been subjected to a pulverizing treatment, a heat treatment was performed at a temperature of 70° C. for 5 hours. Thus, a magnetic iron oxide 1 was obtained.

The magnetic iron oxide 1 had an average particle diameter of 0.25 μm, and a saturation magnetization and a residual magnetization in a magnetic field of 79.6 kA/m (1,000 Oe) of 67.3 $Am^2/kg$ (emu/g) and 4.0 $Am^2/kg$ (emu/g), respectively.

<Production of Toner 1>

450 Parts of a 0.1-mol/L aqueous solution of $Na_3PO_4$ was put into 720 parts of ion-exchanged water, and then the mixture was heated to a temperature of 60° C. After that, 67.7 parts of a 1.0-mol/L aqueous solution of $CaCl_2$ was added to the resultant. Thus, an aqueous medium containing a dispersion stabilizer was obtained.

| | |
|---|---|
| Styrene | 75 parts |
| n-Butyl acrylate | 25 parts |
| Divinylbenzene | 0.5 part |
| Polyester resin 1 | 15 parts |
| Negative charge control agent T-77 (manufactured by HODOGAYA CHEMICAL CO., LTD.) | 1 part |
| Magnetic iron oxide 1 | 90 parts |

The above-mentioned formulations were uniformly dispersed and mixed with an attritor (Mitsui Miike Machinery Co., Ltd.). The resultant monomer composition was heated to a temperature of 60° C., and then 10 parts of E4 as a release agent (a), 5 parts of P2 as a release agent (b), and 4 parts of the polymerization initiator R1 (having a 10-hour halflife temperature of 51° C.) were mixed and dissolved in the composition. Thus, a polymerizable monomer composition was obtained.

The above-mentioned polymerizable monomer composition was put into the aqueous medium, and then the mixture was agitated at a temperature of 60° C. under an $N_2$ atmosphere with a TK-homomixer (Tokushu Kika Kogyo Co.) at 10,000 rpm for 15 minutes so as to be granulated.

After that, a polymerization reaction was performed at a reaction temperature of 70° C. (temperature higher than the 10-hour halflife temperature of R1 by 19° C.) for 360 minutes by agitating the resultant with a paddle agitation blade.

After that, the resultant suspension was cooled to room temperature at a rate of 3° C. per minute, and then hydrochloric acid was added to dissolve the dispersant. The resultant was filtrated, washed with water, and dried. Thus, toner particles 1 were obtained.

100 Parts of the toner particles 1 was mixed with 1.0 part of a hydrophobic silica fine powder that is obtained by treating silica having a primary particle diameter of 12 nm with hexamethyldisilazane and then with silicone oil and has a BET specific surface area after the treatment of 120 $m^2/g$ with a Henschel mixer (Mitsui Miike Machinery Co., Ltd.). Thus, Toner 1 was prepared. Tables 4 and 5 show conditions for the production of Toner 1 and its physical properties.

<Production of Toners 2 to 27>

Toners 2 to 27 were obtained by changing the kinds and amounts of the polyester resin, the release agent (a), the release agent (b), and the polymerization initiator, the reaction temperature, and the rate of temperature decrease of the suspension in the cooling step for terminating the polymerization reaction in the production of Toner 1 as shown in Table 4. Tables 4 and 5 show conditions for the production of Toners 2 to 27 and their physical properties. It should be noted that in the case of each of Toner 12, Toner 21, Toner 23, and Toner 25, the polymerization initiator is further added at the time point when the polymerization conversion degree is 80%.

<Production of Toner 28>

Polymerizable monomers for a core formed of 80.5 parts of styrene and 19.5 parts of n-butyl acrylate (calculated Tg of a copolymer to be obtained=55° C.), 90 parts of the magnetic iron oxide 1, 1 part of a charge control agent (manufactured by HODOGAYA CHEMICAL CO., LTD., trade name: Spilon Black TRH), 0.3 part of divinylbenzene, 0.8 part of t-dodecyl mercaptan, 10 parts of pentaerythritol tetrastearate (stearic acid purity: about 60%), and 2 parts of a natural gas-based Fischer-Tropsch wax (manufactured by D Shell MS Co., trade name: FT-100, peak top temperature of the maximum endothermic peak: 92° C.) were agitated and mixed with a homomixer capable of mixing with a high shear force (TK type, manufactured by Tokushu Kika Kogyo Co.) at a number of revolutions of 12,000 rpm so as to be uniformly dispersed. Thus, a polymerizable monomer composition for a core (mixed liquid) was obtained.

Meanwhile, 5 parts of methyl methacrylate (calculated Tg=105° C.) and 100 parts of water were subjected to a fine dispersion treatment with an ultrasonic emulsifier. Thus, an aqueous dispersion of a polymerizable monomer for a shell was obtained. With regard to the particle diameter of a droplet of the polymerizable monomer for a shell, the D90 measured with a Microtrac particle diameter distribution analyzer by adding the obtained droplet to a 1% aqueous solution of sodium hexametaphosphate at a concentration of 3% was 1.6 μm. On the other hand, an aqueous solution prepared by dissolving 6.9 parts of sodium hydroxide (alkali metal hydroxide) in 50 parts of ion-exchanged water was gradually added to an aqueous solution obtained by dissolving 9.8 parts of magnesium chloride (water-soluble polyvalent metal salt) in 250 parts of ion-exchanged water under agitation. Thus, a dispersion liquid of a magnesium hydroxide colloid (colloid of a hardly water-soluble metal compound) was prepared. The particle diameter distribution of the above-mentioned colloid thus produced was measured with a Microtrac particle diameter distribution analyzer (manufactured by NIKKISO CO., LTD.). As a result, the particle diameter D50 (50% cumulative value of the number particle diameter distribution) was 0.38 μm and the particle diameter D90 (90% cumulative value of the number particle diameter distribution) was 0.82 μm. The measurement with the Microtrac particle diameter distribution analyzer was performed under the following conditions: a measuring range of 0.12 to 704 μm, a measuring time of 30 seconds, and ion-exchanged water as a medium.

The above-mentioned polymerizable monomer composition for a core was put and mixed into the dispersion liquid of the magnesium hydroxide colloid obtained in the foregoing. After that, 4 parts of t-butyl peroxy-2-ethylhexanoate was added to the mixture, and then the whole was agitated by using a TK-homomixer at a number of revolutions of 12,000 rpm with a high shear force so that a droplet of the polymerizable monomer composition for a core was formed. The formed aqueous dispersion of the monomer composition was put into a reaction vessel mounted with an agitation blade, and then a polymerization reaction was initiated at a reaction temperature of 90° C. When the polymerization conversion degree reached substantially 100%, the aqueous dispersion of the polymerizable monomer for a shell and 1 part of a 1% aqueous solution of potassium persulfate were added to the resultant, and then the reaction was continued for 5 hours. After that, the resultant was cooled to room temperature at a rate of 10° C. per minute in order that the reaction be stopped. Thus, an aqueous dispersion of core-shell type polymer particles was obtained. The volume-average particle diameter (dV) of core particles taken out immediately before the addition of the polymerizable monomer for a shell was measured to be 7.1 μm, and the ratio of the volume-average particle diameter to their number-average particle diameter (dV/dP) was 1.26. The shell thickness was 0.12 μm, the value obtained by dividing the longer radius of the toner by its shorter radius (rl/rs) was 1.1, and the content of the toluene-insoluble component was 5%.

While the aqueous dispersion of the core-shell type polymer particles obtained in the foregoing was agitated, acid washing (25° C., 10 minutes) was performed by setting the pH of the system to 4 or less with sulfuric acid, and then water was separated by filtration. After that, 500 parts of ion-exchanged water was newly added to turn the remainder into slurry again, followed by water washing. After that, dehydration and water washing were repeatedly performed again several times, and then solid matter was separated by filtration. After that, the solid matter was dried with a dryer at 45° C. for a whole day and night. Thus, toner particles 28 were obtained.

0.3 part of a colloidal silica (trade name: R-202, manufactured by Degussa Co.) subjected to a hydrophobic treatment was added to 100 parts of the toner particles 28 obtained in the foregoing, and then the contents were mixed with a Henschel mixer. Thus, Toner 28 was prepared. Tables 4 and 5 show the results.

TABLE 4

| Toner No. | Release agent (a) (part(s)) | Release agent (b) (part(s)) | Which one of release agents a and b has larger solubility into binder resin than that of other | Outer shell resin (part(s)) | Polymerization initiator in dissolving step (part(s)) | Polymerization initiator further added when polymerization conversion degree is 80% (part(s)) | Reaction temperature (° C.) | Rate of temperature decrease in cooling step (° C./min) |
|---|---|---|---|---|---|---|---|---|
| 1 | E4 (10) | P2 (5) | a > b | Polyester resin 1 (15) | R1 (4) | — | 70 | 3 |
| 2 | E3 (10) | P2 (5) | a > b | Polyester resin 1 (15) | R1 (4) | — | 70 | 3 |
| 3 | E3 (10) | P3 (5) | a > b | Polyester resin 1 (15) | R1 (4) | — | 70 | 3 |
| 4 | E3 (10) | P3 (5) | a > b | Polyester resin 1 (15) | R1 (4) | — | 70 | 6 |
| 5 | E2 (10) | P1 (5) | a > b | Polyester resin 1 (15) | R1 (4) | — | 70 | 6 |
| 6 | E3 (10) | P1 (5) | a > b | Polyester resin 1 (15) | R1 (4) | — | 70 | 10 |
| 7 | E3 (10) | P1 (5) | a > b | Polyester resin 2 (15) | R1 (4) | — | 70 | 10 |
| 8 | E1 (10) | P1 (5) | a > b | Polyester resin 2 (15) | R1 (4) | — | 70 | 10 |
| 9 | E1 (10) | P1 (5) | a > b | Polyester resin 2 (30) | R1 (4) | — | 70 | 10 |
| 10 | E1 (10) | P1 (5) | a > b | Polyester resin 2 (32) | R1 (4) | — | 70 | 10 |
| 11 | E1 (10) | P1 (5) | a > b | Polyester resin 2 (5) | R1 (8) | — | 70 | 10 |
| 12 | E1 (10) | P1 (5) | a > b | Polyester resin 1 (32) | R2 (10) | R2 (1) | 70 | 10 |
| 13 | E1 (10) | P1 (5) | a > b | Polyester resin 2 (5) | R2 (10) | — | 70 | 10 |
| 14 | E1 (20) | P1 (20) | a > b | Polyester resin 2 (5) | R2 (10) | — | 70 | 10 |
| 15 | E1 (20) | P1 (1) | a > b | Polyester resin 2 (5) | R2 (10) | — | 70 | 10 |
| 16 | E1 (5) | P1 (5) | a > b | Polyester resin 2 (5) | R2 (10) | — | 70 | 10 |

TABLE 4-continued

| Toner No. | Release agent (a) (part(s)) | Release agent (b) (part(s)) | Which one of release agents a and b has larger solubility into binder resin than that of other | Outer shell resin (part(s)) | Polymerization initiator in dissolving step (part(s)) | Polymerization initiator further added when polymerization conversion degree is 80% (part(s)) | Reaction temperature (° C.) | Rate of temperature decrease in cooling step (° C./min) |
|---|---|---|---|---|---|---|---|---|
| 17 | E1 (5) | P1 (0.3) | a > b | Polyester resin 2 (5) | R2 (10) | — | 70 | 10 |
| 18 | E1 (10) | P1 (5) | a > b | Polyester resin 2 (5) | R2 (9) | — | 70 | 10 |
| 19 | E1 (10) | P1 (5) | a > b | Polyester resin 2 (5) | R2 (5) | — | 70 | 10 |
| 20 | E1 (10) | P1 (5) | a > b | Polyester resin 2 (5) | R2 (7) | — | 66 | 10 |
| 21 | E1 (10) | P1 (5) | a > b | Polyester resin 2 (5) | R1 (8) | R1 (1) | 70 | 10 |
| 22 | E1 (10) | P1 (5) | a > b | Polyester resin 2 (5) | R1 (9) | — | 70 | 10 |
| 23 | E1 (10) | P1 (5) | a > b | Polyester resin 2 (5) | R2 (4) | R2 (1) | 70 | 10 |
| 24 | E1 (10) | P1 (5) | a > b | Polyester resin 2 (5) | R3 (10) | — | 70 | 10 |
| 25 | E5 (10) | P1 (5) | a < b | Polyester resin 2 (5) | R2 (4) | R2 (1) | 70 | 10 |
| 26 | E1 (15) | — | — | Polyester resin 2 (5) | R2 (5) | — | 70 | 10 |
| 27 | — | P1 (15) | — | Polyester resin 2 (5) | R2 (5) | — | 70 | 10 |
| 28 | Pentaerythritol tetrastearate | FT 100 (2) | a > b | Methyl methacrylate (5) | t-Butyl peroxy-2-ethylhexanoate (4) | — | 90 | 10 |

TABLE 5

| Toner No. | Total energy of toner particles (mJ) | Average circularity | Proportion of components having molecular weight of 500 or less (area %) | Mw | Rw/Mw | Tma (° C.) | Tmb (° C.) | THF-insoluble component (mass %) | Mn (25° C.) | Mn (135° C.)/ Mn (25° C.) |
|---|---|---|---|---|---|---|---|---|---|---|
| 1 | 750 | 0.970 | 2.0 | 15,000 | $5.0 \times 10^{-3}$ | 73 | 75 | 20 | 3,000 | 17 |
| 2 | 750 | 0.970 | 2.0 | 15,000 | $5.0 \times 10^{-3}$ | 73 | 75 | 20 | 3,000 | 17 |
| 3 | 750 | 0.970 | 2.0 | 15,000 | $5.0 \times 10^{-3}$ | 73 | 77 | 20 | 3,000 | 17 |
| 4 | 750 | 0.970 | 2.0 | 15,000 | $5.0 \times 10^{-3}$ | 73 | 77 | 20 | 3,000 | 17 |
| 5 | 750 | 0.970 | 2.0 | 15,000 | $5.0 \times 10^{-3}$ | 61 | 67 | 20 | 3,000 | 17 |
| 6 | 750 | 0.970 | 2.0 | 15,000 | $5.0 \times 10^{-3}$ | 73 | 67 | 20 | 3,000 | 17 |
| 7 | 800 | 0.970 | 2.0 | 15,000 | $5.0 \times 10^{-3}$ | 73 | 67 | 20 | 3,000 | 17 |
| 8 | 900 | 0.970 | 2.0 | 15,000 | $5.0 \times 10^{-3}$ | 44 | 67 | 20 | 3,000 | 17 |
| 9 | 600 | 0.962 | 2.0 | 15,000 | $5.0 \times 10^{-3}$ | 44 | 67 | 20 | 3,000 | 17 |
| 10 | 500 | 0.958 | 2.0 | 15,000 | $5.0 \times 10^{-3}$ | 44 | 67 | 20 | 3,000 | 17 |
| 11 | 1,100 | 0.970 | 1.5 | 5,000 | $1.0 \times 10^{-2}$ | 44 | 67 | 5 | 1,000 | 22 |
| 12 | 450 | 0.960 | 2.3 | 25,000 | $2.0 \times 10^{-3}$ | 44 | 67 | 15 | 5,000 | 23 |
| 13 | 1,100 | 0.970 | 2.4 | 25,000 | $1.5 \times 10^{-3}$ | 44 | 67 | 20 | 5,000 | 20 |
| 14 | 1,100 | 0.970 | 2.4 | 25,000 | $1.5 \times 10^{-3}$ | 44 | 67 | 20 | 5,000 | 20 |
| 15 | 1,100 | 0.970 | 2.4 | 25,000 | $1.5 \times 10^{-3}$ | 44 | 67 | 20 | 5,000 | 20 |
| 16 | 1,100 | 0.970 | 2.4 | 25,000 | $1.5 \times 10^{-3}$ | 44 | 67 | 20 | 5,000 | 20 |
| 17 | 1,100 | 0.970 | 2.4 | 25,000 | $1.5 \times 10^{-3}$ | 44 | 67 | 20 | 5,000 | 20 |
| 18 | 1,100 | 0.970 | 2.5 | 27,000 | $1.0 \times 10^{-4}$ | 44 | 67 | 25 | 6,000 | 18 |
| 19 | 1,100 | 0.970 | 2.4 | 100,000 | $5.0 \times 10^{-4}$ | 44 | 67 | 40 | 9,000 | 12 |
| 20 | 1,100 | 0.970 | 1.5 | 100,000 | $4.5 \times 10^{-4}$ | 44 | 67 | 32 | 7,000 | 15 |
| 21 | 1,100 | 0.970 | 2.3 | 5,000 | $1.2 \times 10^{-2}$ | 44 | 67 | 3 | 1,000 | 24 |
| 22 | 1,100 | 0.970 | 2.5 | 4,500 | $1.0 \times 10^{-2}$ | 44 | 67 | 3 | 700 | 24 |
| 23 | 1,100 | 0.970 | 1.2 | 105,000 | $5.0 \times 10^{-4}$ | 44 | 67 | 40 | 10,000 | 13 |
| 24 | 1,100 | 0.970 | 2.7 | 80,000 | $6.0 \times 10^{-4}$ | 44 | 67 | 35 | 8,000 | 12 |
| 25 | 1,100 | 0.970 | 1.2 | 105,000 | $5.0 \times 10^{-4}$ | 85 | 67 | 40 | 10,000 | 10 |
| 26 | 1,100 | 0.970 | 1.2 | 100,000 | $5.0 \times 10^{-4}$ | 44 | — | 40 | 9,000 | 12 |
| 27 | 1,100 | 0.970 | 1.2 | 100,000 | $5.0 \times 10^{-4}$ | — | 67 | 40 | 9,000 | 12 |
| 28 | 1,200 | 0.960 | 3.0 | 70,000 | $1.0 \times 10^{-4}$ | 76 | 100 | 35 | 7,000 | 13 |

Example 1

Used as an image-forming apparatus was an LBP-3100 as modified so that the process speed was 125 mm/sec and the abutment pressure between the fixing film and the pressure roller was 7 kgf.

An image having a print percentage of 1% was printed with an 8-point 'A' character under a normal-temperature, normal-humidity environment (having a temperature of 25.0° C. and a humidity of 50% RH) by using Toner 1 in the image-forming apparatus. At this time, image densities at an initial stage and when images were printed on 4,000 sheets according to an intermittent mode were each evaluated. It should be noted that an A4 paper sheet (80 g/m$^2$) was used as a recording medium. As a result, high image densities were obtained throughout the image output test, no density unevenness occurred, and dot reproducibility was satisfactory. The image density at the time of the termination of the test was 1.5 or more, which meant that the acquisition of a high-quality image was attained. In addition, the fixing film was observed after the 4,000-sheet image output test. As a result, no contamination was found.

Further, the same image-forming apparatus was modified so that the fixation temperature of the fixing unit could be adjusted, and then Toner 1 was evaluated for its fixability by using a Xerox paper sheet (75 g/m$^2$) under a normal-temperature, normal-humidity environment (having a temperature of 25.0° C. and a humidity of 50% RH). As a result, the fixation lower limit temperature was less than 180° C., which meant that satisfactory low-temperature fixability was obtained. Table 6 shows the result.

Here, evaluation items described in the examples of the present invention and the comparative examples, and evaluation criteria for the items are described below.

(a) Image Density

Solid image portions were formed and evaluated at an initial stage and after the termination of printout on 4,000 sheets. It should be noted that their image densities were each a relative density of a printout image measured with a "Macbeth Reflection Densitometer" (manufactured by Gretag Macbeth Co.), which is an image density-measuring apparatus, with respect to a white portion having a manuscript density of 0.00.

In addition, each of the produced toners was left to stand under a 42.0° C./95% RH environment for 30 days, and then solid image portions were formed and evaluated at an initial stage after the standing and after the termination of the printout.

A: 1.50 or more

B: 1.40 or more and less than 1.50

C: 1.30 or more and less than 1.40

D: Less than 1.30

(b) Density Unevenness

In the image output test, monochromatic solid images and halftone images were printed out at an initial stage and after the termination of printout on 4,000 sheets, and were then each visually evaluated for its image uniformity.

A: The image is uniform and no image unevenness can be observed.

B: Slight image unevenness can be observed.

C: Image unevenness can be observed but is at a practically acceptable level.

D: Remarkable image unevenness can be observed.

(c) Dot Reproducibility

Figure 4:
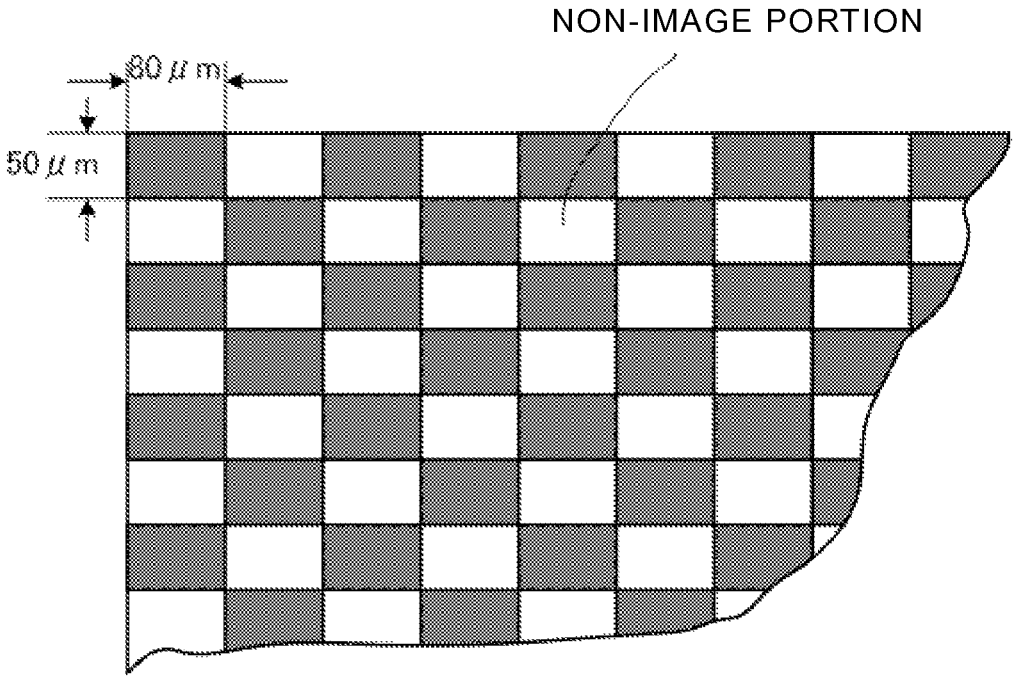
FIG. 4 is an explanatory diagram of a pattern of checkers to be used in an evaluation for dot reproducibility.

An evaluation for dot reproducibility was performed by observing the presence or absence of defect black portions with a microscope at an initial stage and after the termination of printout on 4,000 sheets in an image output test using a checker pattern of 80 μm by 50 μm illustrated in FIG. 4.

A: Two or less defect portions out of 100 portions.

B: Three or more and five or less defect portions out of 100 portions.

C: Six or more and ten or less defect portions out of 100 portions.

D: Eleven or more defect portions out of 100 portions.

(d) Contamination of Fixing Film

The condition where residual toner stuck to the surface of the fixing film after the termination of the printout of solid images on 4,000 sheets, and the solid images were visually evaluated.

A: No contaminations occurred in the fixing film and the images.

B: Nearly no contaminations occurred in the fixing film and the images.

C: Contaminations occurred in the fixing film and the images, but were at practically acceptable levels.

D: A large number of contaminations occurred in the fixing film and the images.

(e) Low-Temperature Fixability

Such an adjustment that the toner applied amount of an unfixed image was 0.6 mg/cm$^2$ was performed. After that, nine 5-cm square solid images were output in an A4 paper sheet at each of fixation temperatures set at a temperature increment of 5° C. in the temperature range of 160° C. or more and 230° C. or less. Each of the images was reciprocally rubbed with a lens-cleaning paper sheet under a load of 4.9 kPa five times, and was then evaluated for its fixation lower limit temperature, which was the temperature at which its density reduced by 15% or more.

A: The fixation lower limit temperature is less than 180° C.

B: The fixation lower limit temperature is 180° C. or more and less than 190° C.

C: The fixation lower limit temperature is 190° C. or more and less than 200° C.

D: The fixation lower limit temperature is 200° C. or more.

Examples 2 to 19

Evaluations for developability at the initial stage and at the time of long-term use, and an evaluation for fixability were performed under conditions identical to those of Example 1 by using each of Toners 2 to 19 instead of Toner 1. As a result, image characteristics at the initial stage were not problematic, and each of the toners results with no serious problems till the termination of printout on 4,000 sheets. Table 6 shows the results of endurance evaluations under a normal-temperature, normal-humidity environment.

Comparative Examples 1 to 9

Evaluations for developability at the initial stage and at the time of long-term use, and an evaluation for fixability were performed under conditions identical to those of Example 1 by using each of Toners 20 to 28 instead of Toner 1. As a result, each of Toners 20 to 28 was at a poor level in terms of the contamination of the fixing film at the time of its long-term use (after printout on 4,000 sheets). In addition, in each of the evaluations of Toners 20 to 28, image deterioration at the time of long-term use, an increase in fixation lower limit temperature, and the contamination of the fixing film occurred, which affected printed images. Table 7 shows the results of endurance evaluations under a normal-temperature, normal-humidity environment.

TABLE 6

| | | Under normal-temperature, normal-humidity environment (25.0° C., 50% RH) | | | | | | | | |
|---|---|---|---|---|---|---|---|---|---|---|
| | | Image density | | | Dot reproducibility | | Density unevenness | | Contamination of | |
| Example | Toner No. | Initial stage | After printout on 4,000 sheets | Initial density after standing at 42.0° C. and 95% RH for 30 days | Initial stage | After printout on 4,000 sheets | Initial stage | After printout on 4,000 sheets | fixing film After printout on 4,000 sheets | Fixation temperature [° C.] |
| 1 | 1 | A(1.59) | A(1.56) | A(1.55) | A | A | A | A | A | A(160) |
| 2 | 2 | A(1.58) | A(1.55) | A(1.54) | A | B | A | A | A | A(165) |
| 3 | 3 | A(1.57) | A(1.54) | A(1.53) | A | B | A | A | A | A(165) |
| 4 | 4 | A(1.57) | A(1.53) | A(1.52) | A | B | A | A | B | A(170) |
| 5 | 5 | A(1.56) | A(1.53) | A(1.51) | A | B | A | B | B | A(170) |
| 6 | 6 | A(1.54) | A(1.51) | A(1.51) | A | B | B | B | B | A(175) |
| 7 | 7 | A(1.54) | B(1.49) | B(1.49) | A | B | B | B | B | A(175) |
| 8 | 8 | A(1.52) | B(1.46) | B(1.46) | B | C | B | B | B | A(175) |
| 9 | 9 | B(1.48) | B(1.43) | B(1.43) | B | C | B | B | B | A(175) |
| 10 | 10 | B(1.47) | B(1.44) | B(1.42) | C | C | B | B | B | A(175) |
| 11 | 11 | B(1.44) | C(1.37) | C(1.38) | C | C | B | C | B | A(170) |
| 12 | 12 | B(1.45) | B(1.40) | B(1.42) | C | C | B | B | B | C(190) |
| 13 | 13 | B(1.43) | C(1.35) | C(1.37) | C | C | B | C | C | B(185) |
| 14 | 14 | B(1.42) | C(1.32) | C(1.38) | C | C | B | C | B | B(185) |
| 15 | 15 | B(1.43) | C(1.36) | B(1.41) | C | C | B | C | C | C(190) |
| 16 | 16 | B(1.43) | C(1.35) | B(1.40) | C | C | B | C | C | B(185) |
| 17 | 17 | B(1.42) | C(1.34) | B(1.40) | C | C | C | C | C | C(195) |
| 18 | 18 | B(1.42) | C(1.34) | C(1.35) | C | C | B | C | C | C(190) |
| 19 | 19 | C(1.37) | C(1.32) | C(1.33) | C | C | C | C | C | C(195) |

TABLE 7

| | | Under normal-temperature, normal-humidity environment (25.0° C., 50% RH) | | | | | | | | |
|---|---|---|---|---|---|---|---|---|---|---|
| | | Image density | | | Dot reproducibility | | Density unevenness | | Contamination of fixing film | |
| Comparative Example | Toner No. | Initial stage | After printout on 4,000 sheets | Initial density after standing at 42.0° C. and 95% RH for 30 days | Initial stage | After printout on 4,000 sheets | Initial stage | After printout on 4,000 sheets | After printout on 4,000 sheets | Fixation temperature [° C.] |
| 1 | 20 | C(1.38) | C(1.32) | C(1.32) | C | C | C | C | D | C(195) |
| 2 | 21 | C(1.34) | D(1.26) | D(1.28) | C | C | C | C | D | B(180) |
| 3 | 22 | C(1.33) | D(1.24) | D(1.24) | C | C | C | D | D | B(180) |
| 4 | 23 | C(1.38) | C(1.34) | D(1.27) | C | C | C | D | D | D(215) |
| 5 | 24 | C(1.37) | C(1.32) | D(1.26) | C | D | C | D | D | D(210) |
| 6 | 25 | C(1.38) | C(1.34) | D(1.27) | C | C | C | D | D | D(220) |
| 7 | 26 | C(1.36) | C(1.31) | C(1.31) | C | D | D | D | D | D(220) |
| 8 | 27 | C(1.35) | C(1.31) | C(1.30) | C | D | D | D | D | D(225) |
| 9 | 28 | C(1.36) | C(1.30) | D(1.26) | C | D | D | D | D | D(205) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-207641, filed Sep. 16, 2010, which is hereby incorporated by reference herein in its entirety.

The invention claimed is:

1. A toner comprising toner particles, each of which contains a binder resin, a coloring agent, a release agent (a), and a release agent (b), wherein:

(1) the release agent (a) is a monofunctional or bifunctional ester wax;

(2) the release agent (b) is a hydrocarbon wax;

(3) a solubility of the release agent (a) into the binder resin is higher than a solubility of the release agent (b) into the binder resin;

(4) when tetrahydrofuran-soluble components of the toner are subjected to measurement by gel permeation chromatography (GPC), a proportion of components having a molecular weight of 500 or less is 2.5 area % or less; and (5) when tetrahydrofuran-soluble components of the toner at 25° C. are subjected to measurement by size exclusion chromatography-multiangle laser light scattering (SEC-MALLS), a weight-average molecular weight Mw thereof is 5,000 or more and 100,000 or less, and the weight-average molecular weight Mw and an radius of gyration Rw thereof satisfy the following equation 1

$$5.0\times10^{-4}\leq Rw/Mw\leq1.0\times10^{-2} \quad \text{Eq. 1.}$$

2. A toner according to claim 1, wherein:

when the tetrahydrofuran-soluble components of the toner at 25° C. are subjected to the measurement by size exclusion chromatography-multiangle laser light scattering (SEC-MALLS), the weight-average molecular weight Mw is 5,000 or more and 25,000 or less; and the weight-average molecular weight Mw and the radius of gyration Rw satisfy the following equation 2

$$2.0\times10^{-3}\leq Rw/Mw\leq1.0\times10^{-2} \quad \text{Eq. 2.}$$

3. A toner according to claim 1, wherein the toner has an average circularity of 0.960 or more.

4. A toner according to claim 1, wherein a total energy of the toner particle as measured with a powder flowability analyzer when a propeller type blade is caused to penetrate a toner particle layer at an agitation rate of 100 mm/sec is 500 mJ or more and 1,000 mJ or less.

5. A toner according to claim 1, wherein the release agent (a) is a monofunctional or bifunctional ester wax having an acid value of 2 mgKOH/g or less and a peak top temperature of a maximum endothermic peak of 60° C. or more and 80° C. or less.

6. A toner according to claim 1, wherein the binder resin comprises, as a main component, a resin obtained by polymerizing a polymerizable monomer with a peroxydicarbonate.

7. A toner according to claim 1, wherein a relationship $0 \leq (Tmb - Tma) \leq 5$ is satisfied, where a peak top temperature of a maximum endothermic peak of the release agent (a) and a peak top temperature of a maximum endothermic peak of the release agent (b) in differential scanning calorimetry (DSC) of the toner are respectively represented by Tma (° C.) and Tmb (° C.).

8. A toner according to claim 1, wherein:

the release agent (a) is incorporated in an amount of 5 parts by mass or more and 20 parts by mass or less with respect to 100 parts by mass of the binder resin; and a mass ratio between contents of the release agent (a) and the release agent (b), (content of the release agent (a))/(content of the release agent (b)), is 1/1 or more and 20/1 or less.

9. A toner according to claim 1, wherein the toner particle is produced by a suspension polymerization method.

10. A toner according to claim 1, wherein a ratio Mn(135° C.)/Mn(25° C.) between a number-average molecular weight Mn(25° C.) when the tetrahydrofuran-soluble components of the toner at 25° C. are subjected to the measurement by size exclusion chromatography-multiangle laser light scattering (SEC-MALLS) and a number-average molecular weight Mn(135° C.) when o-dichlorobenzene-soluble components of the toner at 135° C. are subjected to measurement by size exclusion chromatography-multiangle laser light scattering (SEC-MALLS) is less than 25.

* * * * *